US009740119B2

(12) United States Patent
Jo et al.

(10) Patent No.: US 9,740,119 B2
(45) Date of Patent: Aug. 22, 2017

(54) ELECTROSTATIC IMAGE DEVELOPING TONER

(71) Applicant: MITSUBISHI CHEMICAL CORPORATION, Chiyoda-ku (JP)

(72) Inventors: Usei Jo, Niigata (JP); Tetsuharu Yuge, Kanagawa (JP); Maki Saito, Kanagawa (JP); Masami Tsurumori, Kanagawa (JP)

(73) Assignee: MITSUBISHI CHEMICAL CORPORATION, Chiyoda-ku (JP)

( * ) Notice: Subject to any disclaimer, the term of this patent is extended or adjusted under 35 U.S.C. 154(b) by 0 days.

(21) Appl. No.: 15/003,384

(22) Filed: Jan. 21, 2016

(65) Prior Publication Data

US 2016/0139519 A1 May 19, 2016

Related U.S. Application Data

(63) Continuation of application No. 14/165,891, filed on Jan. 28, 2014, now abandoned, which is a continuation of application No. PCT/JP2012/069029, filed on Jul. 26, 2012.

(30) Foreign Application Priority Data

Jul. 28, 2011 (JP) ..... 2011-165935
Sep. 7, 2011 (JP) ..... 2011-194535

(51) Int. Cl.
*G03G 9/08* (2006.01)
*G03G 9/087* (2006.01)

(52) U.S. Cl.
CPC ..... *G03G 9/081* (2013.01); *G03G 9/0806* (2013.01); *G03G 9/08702* (2013.01); *G03G 9/08711* (2013.01); *G03G 9/08791* (2013.01)

(58) Field of Classification Search
CPC ..... G03G 9/0804
See application file for complete search history.

(56) References Cited

U.S. PATENT DOCUMENTS 6,132,921 A 10/2000 Ishiyama et al.
2003/0149106 A1* 8/2003 Mosbey ..... A01N 59/12 514/554
2008/0003514 A1* 1/2008 Shin ..... G03G 9/08 430/109.3
2008/0226997 A1 9/2008 Nakamura et al.
2009/0029282 A1 1/2009 Bertelsen
2009/0257792 A1 10/2009 Nakamura et al.
2010/0055603 A1 3/2010 Nozaki et al.
2010/0173240 A1 7/2010 Sensui
2011/0076612 A1 3/2011 Awamura et al.
2011/0086305 A1 4/2011 Watanabe et al.
2011/0097659 A1 4/2011 Sugiura et al.

FOREIGN PATENT DOCUMENTS

JP 08044104 2/1996
JP 08-190223 7/1996
JP 08-292601 11/1996
JP 2000-89507 A 3/2000
JP 3067761 5/2000
JP 2000-250266 A 9/2000
JP 2006-184638 7/2006
JP 2009-42617 A 2/2009
JP 2011-141351 7/2011
WO 2007/114502 10/2007
WO WO 2008-150028 A1 12/2008
WO WO 2010-008007 A1 1/2010

OTHER PUBLICATIONS

Office Action issued Sep. 13, 2016, in Japanese Patent Application No. 2012-164829 (w/ machine translated English translation).
Office Action issued Apr. 19, 2016 in Japanese Patent Application No. 2012-164829 (with machine English language translation).
International Search Report issued Oct. 23, 2012 in PCT/JP2012/069029 filed Jul. 26, 2012.
Machine English language translation of JP08044104, Feb. 16, 1996.

* cited by examiner

*Primary Examiner* — Hoa V Le
(74) *Attorney, Agent, or Firm* — Oblon, McClelland, Maier & Neustadt, L.L.P.

(57) ABSTRACT

The invention is to provide a positively charging electrostatic image developing toner capable of providing a high quality and high gloss and excellent in stability in long term use and environmental stability, and especially not causing fog in the use at high temperature and high humidity condition. The present invention relates to an electrostatic image developing toner comprising toner mother particles containing a binder resin and a colorant, wherein the binder resin contains a repeating unit having 4 to 20 ether bonds, containing a carbon atom, a hydrogen atom and an oxygen atom, and accounting for a specific amount.

20 Claims, No Drawings

ELECTROSTATIC IMAGE DEVELOPING TONER

CROSS-REFERENCE TO RELATED APPLICATIONS

The present application is a continuation application of U.S. patent application Ser. No. 14/165,891, filed Jan. 28, 2014, which is a continuation application of International Application No. PCT/JP2012/069029, filed Jul. 26, 2012, which claims priority to Japanese Patent Application No. 2011-165935, filed Jul. 28, 2011 and to Japanese Patent Application No. 2011-194535, filed Sep. 7, 2011. The contents of these applications are incorporated herein by reference in their entirety.

TECHNICAL FIELD

The present invention relates to an electrostatic image developing toner, specifically an electrostatic image developing toner capable of providing a high quality image and high gloss, and excellent in stability in long term use and environmental stability.

BACKGROUND ART

The electrostatic image developing toner is used in image forming to visualize an electrostatic image in a printer, a copier, a facsimile and the like. To take forming of an image by electrophotographic system as an example, in the first place an electrostatic latent image is formed on a photosensitive drum, in the next place the latent image is developed with a toner and the developed image is transferred to a transfer-receiving paper, and the transferred image is fixed with heat or the like, thus an image is formed. The toner used at that time as the electrostatic image developing toner is generally a toner obtained by what is called a melt-kneading pulverizing method of dry blending a charge controlling agent, a release agent, and a magnetic substance, according to necessity, with a binder resin and a colorant, melt-kneading the mixture by an extruder or the like, in the next place pulverizing and classifying the melt-kneaded product to thereby obtain toner particles, and attaching solid particles such as silica as an external additive on the surfaces of the particles for the purpose of imparting various performances such as a flowing property and the like.

In recent years, heightening of a highly precise image quality is required in image formation such as copiers and printers, and for responding such a requirement, it is necessary that the average particle size of toner particles is 3 μm to 8 μm or so and particle size distribution is narrow. However, it is difficult to control particle size and particle size distribution of toner particles in the melt-kneading pulverizing method, and when it is tried to obtain toner particles having an average particle size of 3 μm to 8 μm, high energy is necessary and, further, when the desired particle size is not obtained, there arises a problem such that a process of classification is further necessary.

As a means for solving such a problem in a melt-kneading pulverization method, manufacturing by a polymerization method such as a suspension polymerization method, an emulsification polymerization aggregation method, and a dissolution suspension method is proposed in place of the melt-kneading pulverizing method.

The suspension polymerization method is a method of manufacturing toner particles by suspension dispersing a composition containing a polymerizable monomer, a polymerization initiator and a colorant as the components in an aqueous medium and then polymerizing.

The emulsification polymerization aggregation method is a method of manufacturing toner particles by emulsifying a polymerizable monomer in an aqueous medium containing a polymerization initiator and an emulsifying agent, polymerizing the polymerizable monomer under stirring to obtain polymer primary particles, adding a colorant and, if necessary, a charge controlling agent or the like thereto to aggregate the polymer primary particles, and aging the obtained aggregated particles.

The dissolution suspension method is a method of manufacturing toner particles by dissolving a binder resin in an organic solvent, adding and dispersing a colorant and the like to obtain a solution phase, dispersing the solution phase with mechanical shearing force in an aqueous phase containing a dispersant and the like to form droplets, and removing the organic solvent from the droplets.

According to these polymerization methods, particle size of toner particles can be easily controlled and small size particles can be obtained in narrow particle size distribution, and so toner particles capable of forming high precise image quality can be obtained.

In particular, since the emulsification polymerization aggregation method is a method of manufacturing toner particles by aggregating polymer primary particles obtained by emulsification polymerization with emulsified particles of a colorant or the like, control of the particle size of primary particles is easier as compared with other polymerization method, and the control of the form of toner particles is also feasible. Further, since it is possible to control the structure of the toner more easily by aggregation control, realization of multifunctional performances including low temperature fixation is feasible.

As characteristics affecting image formation, improvement of charging characteristics has also been eagerly examined.

It is necessary to decide the quantity of charge in conformity with the designs of printers, copiers and the like.

There are minus charge and plus charge in the charge, and either of these is adjusted by a charge controlling agent and a binder resin, and it has been pointed out that there are various problems in the control of the quantity of charge of a positively charging toner as compared with that of a negatively charging toner.

Controlling a charging property has been conventionally performed by selection of a charge controlling agent such as a nigrosine dye, a quaternary ammonium salt, a triphenylmethane, or the like, but when such a positively charging toner is used in a two-component developer, the charge controlling agent is spent on the surface of a magnetic carrier during repeating use for a long term, and frictional charging performance of the carrier reduces, which leads to the reduction of image quality, such as the occurrence of what is called fog, PC contamination, staining, generation of an after image (a ghost), blurring (solid-following up), and cleaning performance.

In addition, a nigrosine dye is a dark brown dye and so it can be used only in a black toner, and a quaternary ammonium salt is colorless but it is inferior in a dispersing property in a binder resin, and a charging property is also inferior. If dispersion in a toner is not uniform, fogging increases and the toner causes spattering, and so a uniform dispersing property of a charge controlling agent is the more required in recent years in particle size miniaturization of a toner for aiming at achieving highly precise image quality.

Accordingly, in recent years, studies have been carried out such that a resin having charge controlling performance is used as a charge controlling agent, or various kinds of functional groups are introduced into a binder resin to thereby improve a charging property by making use of the characteristics thereof. For example, monomers containing an amino group or an amide bond are generally used.

When such monomers are used, it is necessary to use an azo-based polymerization initiator in the polymerization of a resin, but it is pointed out that azo-based polymerization initiators have a tendency to be inferior to other polymerization initiators, e.g., peroxide-based polymerization initiator, in the points of environmental stability and a color developing property of the toner. Further, when ordinary azo-based polymerization initiators are used, a toxic substance having a cyano group is generated as a by-product and also an odor deriving from an amino group occurs.

Further, in addition to these problems, there also remains some fear due to poor dispersion of pigments such that color development unevenness is generated, initial rising of charge is insufficient, and the problems of increase in fog and spattering of toner are not completely solved.

For overcoming the concerns as described above, as a means by the improvement of a binder resin, resins for positively charging toners containing one or more components of an acrylic ester component and methacrylic ester component not having an amino group in a resin have been proposed (Patent Documents 1 to 5).

PRIOR ART DOCUMENT

Patent Document

[Patent Document 1] JP-A-5-323660 (the term "JP-A" as used herein refers to an "unexamined published Japanese patent application")

[Patent Document 2] JP-A-5-323661

[Patent Document 3] JP-A-5-323662

[Patent Document 4] JP-A-5-323663

[Patent Document 5] JP-A-5-323670

[Patent Document 6] JP-A-8-292601

SUMMARY OF THE INVENTION

Problems that the Invention is to Solve

However, any of the inventions described in Patent Documents 1 to 5 is an easy method, and any of them has not yet come to obtain an electrostatic image developing toner capable of providing a high quality image and high gloss, and excellent in stability in long term use and environmental stability in addition to the compatibility of a fixing property and blocking resistance.

Also, a positively charging electrostatic image developing toner containing one or more components of an acrylic ester component and methacrylic ester component not having an amino group in a resin is described in Patent Document 6, but the blocking resistance and productivity of the toner cannot be said to be sufficient.

Therefore, the invention provides an electrostatic image developing toner capable of providing a high quality image and high gloss, and excellent in stability in long term use and environmental stability, especially an electrostatic image developing toner not causing fog in the use at high temperature and high humidity conditions, above all the invention provides a positively charging electrostatic image developing toner.

Means for Solving the Problems

For solving the above problems, the present inventors repeated examinations and found that the above problems can be solved by an electrostatic image developing toner which contains toner mother particles containing a binder resin and a colorant, wherein the repeating unit contained in the binder resin has a carbon atom, a hydrogen atom and an oxygen atom, and also has 4 or more and 20 or less ether bonds, which resin is contained in the toner mother particles in a specific amount. The invention is based on the knowledge, and the essential points of the invention are as follows.

<1> An electrostatic image developing toner comprising toner mother particles containing a binder resin and a colorant, wherein the electrostatic image developing toner satisfies the following conditions (1) to (4):

(1) the binder resin contains a repeating unit having 4 to 20 ether bonds, (2) the repeating unit contains a carbon atom, a hydrogen atom and an oxygen atom, (3) the repeating unit accounts for 0.1 parts by mass to 10 parts by mass in 100 parts by mass of the toner mother particles, and (4) the toner mother particles are obtained by a wet polymerization method.

<2> The electrostatic image developing toner as described in the item <1>, wherein the wet polymerization method is an emulsification polymerization aggregation method.

<3> The electrostatic image developing toner as described in the item <1> or <2>, wherein the toner mother particles are positively charging particles.

<4> The electrostatic image developing toner as described in any one of the items <1> to <3>, which further comprises an external additive.

<5> The electrostatic image developing toner as described in the item <4>, wherein the external additive contains an electrically conductive metal oxide.

<6> The electrostatic image developing toner as described in the item <5>, wherein the electrically conductive metal oxide is an electrically conductive titanium oxide.

<7> The electrostatic image developing toner as described in the item <6>, wherein the electrically conductive titanium oxide is contained in an amount of 0.1 parts by mass or more to 100 parts by mass of the toner mother particles.

<8> The electrostatic image developing toner as described in any one of the items <4> to <7>, wherein the external additive further contains silica.

<9> The electrostatic image developing toner as described in the item <8>, wherein the silica comprises silica A having a volume average primary particle size of 5 nm or more and 15 nm or less, and silica B having a volume average primary particle size greater than that of the silica A by 5 nm or more.

<10> The electrostatic image developing toner as described in any one of the items <4> to <9>, wherein the external additive contains positively charging inorganic particles treated with an amino group-containing compound.

Advantage of the Invention

According to the invention, an electrostatic image developing toner capable of providing a high quality image and high gloss, and excellent in stability in long term use and environmental stability, especially a positively charging electrostatic image developing toner can be provided.

This effect can be obtained by a binder resin having stable quantity of charge and environmental stability, by which deterioration of a charging property due to long term use and use under severe conditions does not occur, and deterioration of image quality is not caused. Further, as compared with binder resins deriving from conventionally used polymerizable monomers, the binder resin according to the invention is excellent in moisture resistance, and so environmental stability is exhibited.

MODE FOR CARRYING OUT THE INVENTION

The toner mother particles in the invention contain a binder resin and a colorant, and in addition to them, if necessary, may contain wax and a charge controlling agent. The toner mother particles in the invention are manufactured by a wet polymerization method.

In the invention, particles in the state before external additives are attached are referred to as toner mother particles and particles after external additives are attached to the surfaces of the toner mother particles are referred to as toners. Incidentally, "parts by mass" and "parts by weight" have the same meaning.

<Toner Mother Particles>

As the wet polymerization methods for manufacturing toner mother particles, a suspension polymerization method, an emulsification polymerization aggregation method and a dissolution suspension method are exemplified, but the invention is not restricted to these methods.

In the suspension polymerization method, toner mother particles are generally obtained by dissolving a colorant and wax in a binder resin monomer, and suspending the monomer solution in an aqueous medium by mechanical shearing force as monomer drops to perform polymerization.

In the emulsification polymerization aggregation method, in general, a polymerizable monomer constituting a binder resin is emulsified in an aqueous medium containing a polymerization initiator, an emulsifier, and the like, polymerizing the polymerizable monomer under stirring to obtain polymer primary particles, and adding the dispersion liquid of a colorant and, if necessary, a charge controlling agent to aggregate the polymer primary particles. And toner mother particles are obtained by aging the obtained aggregated particles.

In the dissolution suspension method, in general, a binder resin, wax, and the like are dissolved in a solvent to thereby obtain an oil phase, suspending the oil phase in an aqueous medium as oil drops, and removing the solvent, thus toner mother particles are obtained.

From the point of capable of easily controlling the physical characteristics of the obtained toner, the emulsification polymerization aggregation method is preferred of the above wet polymerization methods.

In the invention, a polymerizable monomer constituting a binder resin corresponds to the repeating unit contained in the binder resin, and the repeating unit has 4 or more and 20 or less ether bonds, and the monomer is not especially restricted so long as it has a carbon atom, a hydrogen atom and an oxygen atom. When the number of ether bonds is distributed in a wide range, the average value of the number of bonds is taken as the number of ether bonds.

By containing ether bonds, the polymerizable monomer gives a hydrophilic property necessary to stabilize particles in water during manufacture of the toner by the polymerization method and imparts a positive charging property to the toner mother particles.

It is essential that the number of ether bonds in the polymerizable monomer is 4 or more, preferably 5 or more from the point of stabilization of the particles in water, and more preferably 6 or more, on the other hand, it is essential that the number of ether bonds is 20 or less, preferably 15 or less, more preferably 12 or less, and still more preferably 10 or less.

When the number of ether bonds is too few, there are cases where a charging property is insufficient, while when the number is too many, there are cases where a preserving property and moisture resistance are deteriorated.

The polymerizable monomer having ether bonds for use in the invention is preferably nonionic from a preserving property and environmental resistance of the toner, and the polymerizable monomer having ether bonds means a monomer having a functional group capable of radical polymerization. For example, (meth)acrylic esters, vinyl ethers, vinyl esters, styrenes, and the like are exemplified, and a part of them is represented by the following formula 1 or 2:

[Chem. 1]

Formula 1

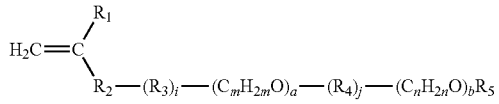

wherein $R_1$ represents a hydrogen atom or a methyl group; $R_2$ represents an ester group, an ether group, or a phenylene group; each of $R_3$ and $R_4$ represents a structure having a carbon atom, a hydrogen atom, and an oxygen atom; $R_5$ represents a structure having a carbon atom, a hydrogen atom, an oxygen atom, and, if necessary, a chlorine atom, such as an alkyl group, a phenyl group, or an alkylphenyl group; each of a and b independently represents an integer of 0 or more, and the sum of a and b is 2 or more; each of i and j independently represents 0 or 1; and each of 1, m and n independently represents an integer of 1 or more.

[Chem. 2]

Formula 2

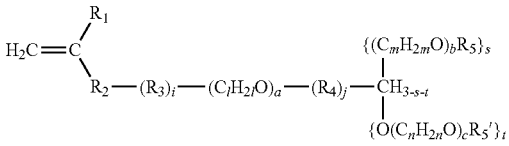

wherein $R_1$ represents a hydrogen atom or a methyl group; $R_2$ represents an ester group, an ether group, or a phenylene group; each of $R_3$ and $R_4$ represents a structure having a carbon atom, a hydrogen atom, and an oxygen atom; each of $R_5$ an $R_{5'}$ independently represents a structure having a carbon atom, a hydrogen atom, an oxygen atom, and, if necessary, a chlorine atom, such as an alkyl group, a phenyl group, or an alkylphenyl group; each of a, b and c independently represents an integer of 0 or more; each of i and j independently represents 0 or 1; each of 1, m and n independently represents an integer of 1 or more; each of s and t independently represents an integer of 0 to 2; and a+b*s+(c+1)*t is 2 or more.

More specifically, the examples thereof include polyalkylene glycol mono(meth)acrylates having an alkyl group at a terminal, such as methoxy polyethylene glycol mono(meth) acrylate, octoxy polyethylene glycol polypropylene glycol mono(meth)acrylate, lauroxy polyethylene glycol mono (meth)acrylate, stearoxy polyethylene glycol mono(meth) acrylate, phenoxy polyethylene glycol mono(meth)acrylate, nonylphenoxy polypropylene glycol mono(meth)acrylate, and the like, polyalkylene glycol mono(meth)acrylates having a hydroxyl group at a terminal, such as polyethylene glycol mono(meth)acrylate, polypropylene glycol mono (meth)acrylate, polyethylene glycol polypropylene glycol mono(meth)acrylate, and the like, and in addition to the above, vinyl ether compounds, such as methoxy polyethylene glycol vinyl ether, polyethylene glycol vinyl ether, and the like, vinyl ester compounds, such as methoxy polyethylene glycol vinyl ester, polyethylene glycol vinyl ester, and the like, and styrene compounds, such as methoxy polyethylene glycol styrene, polyethylene glycol styrene, 4-(methoxymethoxy)styrene, and the like can be used, but the invention is not restricted to these examples.

These monomers can be arbitrarily selected according to the composition of the binder resin constituting the toner of the invention and the kind of wax, and they may be used alone, or two or more monomers having different numbers of ether bonds may be used in combination, or two or more monomers having structures different in the parts other than ether bonds may be used in combination.

It is essential that the repeating unit having ether bonds contained in the binder resin in the invention is contained in an amount of 0.1 parts by mass or more in 100 parts by mass of the toner mother particles, preferably 0.5 parts by mass or more, more preferably 1 part by mass or more, still more preferably 2 parts by mass or more, and most preferably 4 parts by mass or more. On the other hand, it is essential that the repeating unit having ether bonds is contained in an amount of 10 parts by mass or less in 100 parts by mass of the toner mother particles, and preferably 8 parts by mass or less. When the content of the repeating unit part is too little, there are cases where a charging property is insufficient, while when it is too much, there are cases where a preserving property and moisture resistance are deteriorated.

In the invention, as the monomer component for use for manufacturing a binder resin by copolymerization with a polymerizable monomer having ether bonds, monomers conventionally used for manufacturing binder resins of toners can be arbitrarily used.

For example, any polymerizable monomer of a polymerizable monomer having an acid group (hereinafter sometimes merely referred to as an acid monomer), a polymerizable monomer having a basic group (hereinafter sometimes merely referred to as a basic monomer), and a polymerizable monomer having neither an acid group nor a basic group (hereinafter sometimes merely referred to as other monomers) can be used.

When toner mother particles are manufactured by an emulsification polymerization aggregation method, in the emulsification polymerization process, polymerizable monomers are generally polymerized in an aqueous medium in the presence of an emulsifier. In supplying polymerizable monomers to the reaction system, each monomer may be added separately, or two or more kinds of monomers may be mixed in advance and added at the same time. Monomers may be added as they are, or they may be mixed with water and an emulsifier in advance and added as a prepared emulsion liquid.

The examples of acid monomers include polymerizable monomers having a carboxyl group, such as an acrylic acid, a methacrylic acid, a maleic acid, a fumaric acid, a cinnamic acid, and the like, polymerizable monomers having a sulfonic acid group, such as sulfonated styrene and the like, and polymerizable monomers having a sulfonamide group, such as vinylbenzene sulfonamide and the like.

The examples of basic monomers include aromatic vinyl compounds having an amino group, such as aminostyrene and the like, nitrogen-containing aromatic ring-containing polymerizable monomers, such as vinyl pyridine, vinyl pyrrolidone, and the like, (meth)acrylic esters having an amino group, such as dimethylaminoethyl acrylate, diethylaminoethyl methacrylate, and the like.

These acid monomers and basic monomers contribute to the stabilization of the particles in water in the process of the manufacture of toner mother particles by the suspension polymerization method, emulsification polymerization aggregation method, dissolution suspension method or the like with polymerizable monomers having ether bonds having a radical property used in the invention. Acid monomers and basic monomers copolymerized with polymerizable monomers having ether bonds may be used alone, or may be used as mixture of two or more kinds, or may be present as salts with counter ions.

The rate of a polymerizable monomer having ether bonds accounting for in 100 parts by mass of the sum of a polymerizable monomer having ether bonds, an acid monomer and a basic monomer is generally 50 parts by mass or more, preferably 70 parts by mass or more, and more preferably 90 parts by mass or more.

The greatest lower bound of the total amount of a polymerizable monomer component having ether bonds, an acid monomer component and a basic monomer component accounting for in 100 parts by mass of the total monomer components for constituting a binder resin is generally 0.1 parts by mass or more, preferably 0.5 parts by mass or more, more preferably 1 part by mass or more, and, on the other hand, the least upper bound is generally 10 parts by mass or less, preferably 6 parts by mass or less, more preferably 5 parts by mass or less.

The examples of other monomers for constituting the binder resin include styrenes, such as styrene, methylstyrene, chlorostyrene, dichlorostyrene, p-tert-butylstyrene, p-n-butylstyrene, p-n-nonylstyrene, and the like, acrylic esters, such as methyl acrylate, ethyl acrylate, propyl acrylate, n-butyl acrylate, isobutyl acrylate, hydroxyethyl acrylate, 2-ethylhexyl acrylate, and the like, methacrylic esters, such as methyl methacrylate, ethyl methacrylate, propyl methacrylate, n-butyl methacrylate, isobutyl methacrylate, hydroxyethyl methacrylate, 2-ethylhexyl methacrylate, and the like, acrylamide, N-propylacrylamide, N,N-dimethylacrylamide, N,N-dipropylacrylamide, N,N-dibutylacrylamide, and the like. These other monomers may be used alone, or two or more monomers may be used in combination.

Further, when a crosslinkable resin is used as the binder resin, a polyfunctional monomer having radical polymerizability is used together with the above monomers, and the examples thereof include divinylbenzene, hexanediol diacrylate, ethylene glycol dimethacrylate, diethylene glycol dimethacrylate, triethylene glycol dimethacrylate, tetraethylene glycol dimethacrylate, hexaethylene glycol dimethacrylate, nonaethylene glycol dimethacrylate, diethylene glycol diacrylate, triethylene glycol diacrylate, neopentyl glycol dimethacrylate, neopentyl glycol diacrylate, diallyl phthalate, and the like.

Further, it is also possible to use polymerizable monomers having a reactive group in a pendant group, for example, glycidyl methacrylate, methylol acrylamide, acrolein, and the like can be used. A radical polymerizable bifunctional polymerizable monomer is preferred of them, and divinylbenzene and hexanediol diacrylate are especially preferred.

These polyfunctional polymerizable monomers may be used alone, or two or more kinds may be used as mixture.

The number average molecular weight of the binder resin by gel permeation chromatography (hereinafter referred to as GPC) is preferably 2,000 or more, more preferably 2,500 or more, still more preferably 3,000 or more, and preferably 50,000 or less, more preferably 40,000 or less, still more preferably 35,000 or less. Also, the weight average molecular weight found by GPC is preferably 50,000 or more, more preferably 100,000 or more, still more preferably 200,000 or more, and preferably 2,000,000 or less, more preferably 1,000,000 or less, still more preferably 500,000 or less. When the number average molecular weight and the weight average molecular weight of the binder resin are in the above ranges, the durability, preservation property and fixing property of the toner are good, and so preferred.

In polymerization of a binder resin, if necessary, one or two or more kinds of known polymerization initiators may be used in combination. The examples of polymerization initiators include persulfates, such as potassium persulfate, sodium persulfate, ammonium persulfate, and the like, redox initiators obtained by combining the above persulfate as one component with a reducing agent such as acidic sodium sulfite, water-soluble polymerization initiators, such as hydrogen peroxide, 4,4-azobis-cyanovaleric acid, t-butyl hydroperoxide, cumene hydroperoxide, and the like, redox initiators obtained by combining the above water-soluble polymerization initiator as one component with a reducing agent such as ferrous salt or the like, benzoyl peroxide, 2,2-azobisisobutyronitrile and the like. These polymerization initiators may be added to the polymerization system at any time of before addition of the monomer, at the same time with the addition of the monomer, or after the addition, and these addition methods may be combined according to necessity.

In polymerization of a binder resin, if necessary, known chain transfer agents may be used. The specific examples of such chain transfer agents include t-dodecyl mercaptan, 2-mercaptoethanol, diisopropylxanthogen, carbon tetrachloride, trichlorobromomethane, and the like. Chain transfer agents may be used alone, or may be used in combination of two or more kinds, and the amount to be used is 0% by weight to 5% by weight based on the polymerizable monomer.

In polymerization of a binder resin, if necessary, known suspension stabilizers may be used. The specific examples of such suspension stabilizers include calcium phosphate, magnesium phosphate, calcium hydroxide, magnesium hydroxide, and the like. These suspension stabilizers may be used alone, or two or more kinds may be used in combination. Suspension stabilizers are used in an amount of 1 part by mass or more and 10 parts by mass or less based on 100 parts by mass of the sum of all the monomer components for constituting the binder resin.

Suspension stabilizers may be added to the polymerization system at any time of before addition of the monomer, at the same time with the addition of the monomer, or after addition, and these addition methods may be combined according to necessity.

In addition to the above, a pH controlling agent, a polymerization degree-controlling agent, a defoaming agent and the like may be arbitrarily added to the reaction system of the binder resin.

In the invention, when a binder resin is polymerized by emulsification polymerization, known emulsifiers may be used. As such emulsifiers, one or two or more emulsifiers selected from a cationic surfactant, an anionic surfactant, and a nonionic surfactant may be used in combination.

The examples of cationic surfactants include, for example, dodecylammonium chloride, dodecylammonium bromide, dodecyltrimethylammonium bromide, dodecyldimethylbenzylammonium chloride, dodecylpyridinium chloride, dodecylpyridinium bromide, hexadecyltrimethylammonium bromide, and the like.

The examples of anionic surfactants include, for example, fatty acid soaps, such as sodium stearate, sodium dodecanoate, and the like, sodium dodecylsulfate, sodium dodecylbenzenesulfonate, sodium laurylsulfate, and the like.

The examples of nonionic surfactants include, for example, polyoxyethylene dodecyl ether, polyoxyethylene hexadecyl ether, polyoxyethylene nonylphenyl ether, polyoxyethylene lauryl ether, polyoxyethylene sorbitan monooleate ether, monodecanoyl sucrose, and the like.

The amount of an emulsifier used is preferably 0.1 parts by mass or more and 10 parts by mass or less per 100 parts by mass of all the monomers for constituting the binder resin. Further, together with such an emulsifier, one or two or more polyvinyl alcohols such as partially or completely saponified polyvinyl alcohol and the like, and cellulose derivatives such as hydroxyethyl cellulose and the like may be used in combination as protective colloid.

The volume average particle size of the polymer primary particles obtained by emulsification polymerization is generally 0.02 μm or more, preferably 0.05 μm or more, more preferably 0.1 μm or more, and is generally 3 μm or less, preferably 2 μm or less, still more preferably 1 mμ or less. When the particle size is smaller than the above range, there are cases where the control of the aggregation rate in the aggregation process becomes difficult, while when the particle size is larger than the above range, there are cases where the particle size of the toner mother particle obtained by aggregation is liable to become too large and it is difficult to obtain a toner having the particle size of the objective.

Wax can be used in the toner mother particles in the invention as the offset preventive. In recent years, improvement of the fixing property of toner at a low temperature has been tried. Low temperature fixation and blocking resistance, high temperature offset resistance are generally in the relationship of antinomy, and for attaining the reconciliation of these, wax is preferably used as the offset preventive.

Known waxes may be optionally used. The specific examples of waxes include olefin waxes, such as low molecular weight polyethylene, low molecular weight polypropylene, copolymer polyethylene, and the like, paraffin wax, ester waxes having a long chain aliphatic group, such as behenyl behenate, montanate, stearyl stearate, and the like, vegetable waxes, such as hydrogenated castor oil, carnauba wax, and the like, ketones having a long chain alkyl group, such as distearyl ketone and the like, silicones having an alkyl group, higher fatty acids such as stearic acid and the like, a long chain fatty acid alcohol, a long chain fatty acid polyhydric alcohols such as pentaerythritol, a partial ester thereof, and higher fatty acid amides, such as oleic acid amide, stearic acid amide, and the like, and preferably hydrocarbon-based waxes, such as paraffin wax and Fischer-Tropsch wax, ester-based wax, and silicone-based wax are exemplified.

Waxes may be used alone, or two or more waxes may be used in combination as a mixture. Further, for improving the fixing property, the melting temperature of these waxes is preferably 110° C. or less, more preferably 90° C. or less, and especially preferably 80° C. or less. The greatest lower bound of the melting temperature is preferably 40° C. or more, and more preferably 50° C. or more. When the melting temperature is too high, there are cases where the effect of lowering the fixing temperature is inferior, while when the melting temperature is too low, there are cases where problems arise in the consolidation and preservation stability.

The amount of the wax to be used is preferably 1 part by mass or more in 100 parts by mass of the toner mother particles, more preferably 2 parts by mass or more, and still more preferably 5 parts by mass or more. Also, the amount is preferably 40 parts by mass or less, more preferably 35 parts by mass or less, and still more preferably 30 parts by mass or less. When the content of the wax in the toner mother particles is too little, there are cases where performance such as offset property at a high temperature is not sufficient, while when the content is too much, blocking resistance is not sufficient or the wax leaks out of the toner, as a result sometimes the apparatus is soiled.

As the compounding method of wax to the polymerization system, it is preferred to disperse the wax in water in advance in the state of the volume average particle size of 0.01 μm or more and 2.0 μm or less. The volume average particle size is more preferably 1.0 μm or less, and especially preferably 0.5 μm or less.

Further, when toner mother particles are manufactured by an emulsification polymerization aggregation method, the dispersion liquid of wax which is dispersed in the above range of the volume average particle size is preferably added to the polymerization system at the time of emulsification polymerization or in the aggregation process.

For dispersing the wax in the toner mother particles in a preferred dispersion particle size, what is called seed polymerization, i.e., the wax is added as seed at the time of emulsification polymerization, is preferably used. Since the wax is finely and uniformly dispersed in the toner mother particles by the addition as seed, deterioration of the charging property and heat resistance of the toner at large can be inhibited.

Further, it is also possible to prepare the dispersion liquid of wax/long chain polymerizable monomer by dispersing the wax in advance in an aqueous dispersion medium with a long chain polymerizable monomer such as stearyl acrylate, and polymerize a polymerizable monomer in the presence of a wax/long chain polymerizable monomer.

Well-known colorants can be optionally used as the colorants contained in the toner mother particles in the invention. The specific examples of such colorants include carbon black, Aniline Blue, Phthalocyanine Blue, Phthalocyanine Green, Hansa Yellow, Rhodamine-based dyes or pigments, Chrome Yellow, Quinacridone, Benzidine Yellow, Rose Bengal, triallylmethane-based dyes, monoazo-based, disazo-based, condensed azo-based dyes or pigments, and the like. These known dyes or pigments may be used alone, or as a mixture.

When the toner according to the invention is a full color toner, it is preferred to use Benzidine Yellow, monoazo-based, or condensed azo-based dyes or pigments as yellow, Quinacridone, monoazo-based dyes or pigments as magenta, and Phthalocyanine Blue as cyan. The amount of the colorants to be used is preferably 3 parts by mass or more and 20 parts by mass or less per 100 parts by mass of the polymer primary particles.

The compounding of the colorants in the emulsification polymerization aggregation method is generally performed in the aggregation process. The dispersion liquid of polymer primary particles and the dispersion liquid of colorant particles are mixed to prepare a mixed dispersion liquid, and then the mixed dispersion liquid is aggregated to thereby obtain particle aggregates. Colorants are preferably used in the state of being dispersed in water in the presence of an emulsifier. The volume average particle size of the colorant particles is preferably 0.01 μm or more, more preferably 0.05 μm or more, and is preferably 3 μm or less, more preferably 1 μm or less.

In the invention, when a charge controlling agent is used, well-known optional charge controlling agents may be used alone or in combination.

For example, as positively charging charge controlling agents, a quaternary ammonium salt, basic/electron donating metallic materials, a triaminotriphenyl-methane compound, an imidazole compound, a polyamine resin, charge controlling resins such as copolymers containing an amino group or a quaternary ammonium group, and the like are exemplified.

As negatively charging charge controlling agents, a metal chelate, a metal salt of an organic acid, a metal-containing dye, a nigrosine dye, an amide group-containing compound, a phenol compound, a naphthol compound and metal salts thereof, a urethane bond-containing compound, an acidic or electron-withdrawing organic material are exemplified.

When the electrostatic image developing toner according to the invention is used as a toner other than a black toner in a color toner or a full color toner, it is preferred to use a colorless or pale colored charge controlling agent free from color tone hindrance to the toner.

For example, as the positively charging charge controlling agent, a quaternary ammonium salt compound is preferred, and as the negatively charging charge controlling agent, a metal salt or metal complex of a salicylic acid or an alkyl salicylic acid with chromium, zinc, aluminum or the like, a metal salt or metal complex of a benzilic acid, an amide compound, a phenol compound, a naphthol compound, a phenolamide compound, a hydroxynaphthalene compound such as 4,4'-methylenebis-[2-[N-(4-chlorophenyl)amide]-3-hydroxynaphthalene], and the like are preferred.

In the invention, when a charge controlling agent is incorporated into a toner in the case of manufacturing toner mother particles by an emulsification polymerization aggregation method, compounding can be performed by any of the following methods, i.e., a method of incorporating a charge controlling agent with a polymerizable monomer and the like at the time of emulsification polymerization, a method of incorporating a charge controlling agent with polymer primary particles, a colorant and the like in the aggregation process, and a method of aggregating polymer primary particles and a colorant so as to obtain an almost objective particle size, and then incorporating a charge controlling agent to the aggregates. Of these methods, it is preferred to disperse a charge controlling agent in water by using a surfactant and to introduce the obtained dispersion liquid having a volume average particle size of 0.01 μm or more and 3 μm or less to the aggregation process.

The toner mother particles in the invention may be manufactured by any polymerization method of a suspension polymerization method, an emulsification polymerization aggregation method, and a dissolution suspension method and the invention is not especially restricted. An emulsification polymerization aggregation method is preferred of these methods from the viewpoint of easiness of control of the physical characteristics of the toner to be obtained.

Specific methods of a suspension polymerization and an emulsification polymerization aggregation are described below.

In the manufacturing method of toner mother particles by suspension polymerization, a monomer composition is prepared by adding a colorant, a polymerization initiator, and if necessary, additives such as wax, a polar resin, a charge controlling agent, a crosslinking agent and the like to the above binder resin monomer, and uniformly dissolving or dispersing them. The thus-prepared monomer composition is dispersed in an aqueous medium containing a dispersion stabilizer and the like. Preferably, the rate and time of stirring are adjusted so that the drops of the monomer composition have a desired size of the toner particles, and granulated. After that, stirring is carried out in a degree capable of maintaining a particle state and preventing the precipitation of the particles by the function of the dispersion stabilizer to effect polymerization. The compound after polymerization is washed and collected by filtration and dried to obtain toner mother particles. The toner according to the invention can be obtained by performing external addition and the like, if necessary.

The manufacturing method by an emulsification polymerization aggregation method includes a process of aggregating the dispersion liquid of polymer primary particles and the dispersion liquid of a colorant. Specifically, the dispersion liquid of a colorant and the dispersion liquid of wax are prepared in advance, and the emulsification polymerization aggregation method includes a first method, wherein polymer primary particles of the binder resin monomer obtained by emulsification polymerization or polymer primary particles of the binder resin monomer containing wax obtained by emulsification polymerization in the presence of the dispersion liquid of wax are mixed with the dispersion liquid of a colorant and the dispersion liquid of wax, and heated to effect aggregation through an aggregation process, followed by a aging process, a second method, wherein polymer primary particles of the binder resin monomer obtained by emulsification polymerization in the presence of a colorant or in the presence of a colorant and wax are mixed with the dispersion liquid of wax, and heated to effect aggregation through an aggregation process, followed by a aging process, and a third method, wherein polymer primary particles of the binder resin monomer obtained by emulsification polymerization in the presence of a colorant and wax are mixed with the dispersion liquid of wax, and heated to effect aggregation through an aggregation process, followed by a aging process. The compound after polymerization is washed and collected by filtration and dried to obtain toner mother particles. The toner according to the invention can be obtained by performing external addition and the like, if necessary.

Of the above manufacturing methods of the emulsification polymerization aggregation method, the emulsification polymerization aggregation method of adding the dispersion liquid of a colorant in the aggregation process, not adding a colorant at the time of emulsification polymerization, is preferred, since when the binder resin monomer is polymerized in the presence of a colorant, the metal in the colorant affects radical polymerization and the control of the molecular weight and rheology of the resin becomes difficult and there is the possibility that desired polymer primary particles cannot be obtained.

In the aggregation process of the emulsification polymerization aggregation method, the above-described compounding components, such as polymer primary particles, colorant particles, and if necessary, charge controlling agent and wax are mixed at the same time or one after another, but it is preferred to prepare in advance a dispersion liquid of each component, i.e., the dispersion liquid of polymer primary particles, the dispersion liquid of colorant particles, and if necessary, the dispersion liquid of a charge controlling agent and the dispersion liquid of wax particles, and to mix these dispersion liquids to obtain a mixed dispersion liquid in view of uniformity of the composition and uniformity of the particle sizes.

In the emulsification polymerization aggregation method, aggregation is generally carried out in a tank provided with a stirrer, and aggregation may be performed by a method of heating, a method of adding an electrolyte, or a combination of these methods. When polymer primary particles are aggregated with stirring to obtain aggregates of the particles having a desired size, the particle size of the particle aggregates is controlled by the balance between the aggregation force among particles and the shearing force by stirring, and the aggregation force can be increased by heating or by the addition of an electrolyte.

As the electrolytes to be added to perform aggregation, any of an organic or inorganic acid, alkali and salt may be used.

Specifically, as acids, a hydrochloric acid, a nitric acid, a sulfuric acid, a citric acid, and the like are exemplified. As alkalies, sodium hydroxide, potassium hydroxide, aqueous ammonia and the like are exemplified. As salts, NaCl, KCl, LiCl, $Na_2SO_4$, $K_2SO_4$, $Li_2SO_4$, $MgCl_2$, $CaCl_2$, $MgSO_4$, $CaSO_4$, $ZnSO_4$, $Al_2(SO_4)_3$, $Fe_2(SO_4)_3$, $CH_3COONa$, $C_6H_5SO_3Na$, and the like are exemplified.

Of these, an inorganic salt having a divalent or higher valent metal cation is preferred.

The addition amount of the electrolyte varies depending upon the kind of the electrolyte, the objective particle size and the like, but is preferably 0.05 parts by mass or more per 100 parts by mass of the solids content of the mixed dispersion liquid, more preferably 0.1 parts by mass or more, and preferably 25 parts by mass or less, more preferably 15 parts by mass or less, especially preferably 10 parts by mass or less. When the addition amount is too little, there are cases where the progress of the aggregation reaction is liable to be slow, and fine powder of 1 μm or less remains after the aggregation reaction, or the average particle size of the obtained aggregates of particles sometimes does not reach the objective particle size. While when the addition amount is too much, problems may arise such that the aggregation is liable to progress fast and the control of the particle size becomes difficult, or coarse particles or uneven particles may be contained in the obtained aggregated particles.

The aggregation temperature in the case where aggregation is performed by adding an electrolyte is preferably 20° C. or more, more preferably 30° C. or more, and preferably 80° C. or less, more preferably 70° C. or less, and still more preferably 60° C. or less.

The aggregation temperature in the case where aggregation is performed only by heating without using an electrolyte is preferably (Tg−20)° C. or more, and more preferably (Tg−10)° C. or more, taking the glass transition temperature of the polymer primary particles as Tg. Further, Tg or less is preferred, and (Tg−5)° C. or less is more preferred.

The time required for aggregation is optimized by the shape of the apparatus or the scale of treatment, but to bring the particle size of the toner into the objective particle size, it is generally preferred to maintain the system at the prescribed temperature for at least 30 minutes or more. The temperature may be raised to the prescribed temperature at a constant rate or may be raised stepwise.

To the surfaces of the particle aggregates after the aggregation treatment, if necessary, resin fine particles may also be attached or fixed. By attaching or fixing resin fine particles having the properties controlled to the surfaces of the particle aggregates, there are cases where the charging property and heat resistance of the toner to be obtained are improved, and the effects of the invention can further be conspicuous.

When resin fine particles having a glass transition temperature higher than the glass transition temperature of the polymer primary particles are used as the resin fine particles, a further improvement of the blocking resistance can be preferably realized without impairing the fixing property.

The volume average particle size of the resin fine particles is preferably 0.02 μm or more, more preferably 0.05 μm or more, and preferably 3 μm or less, more preferably 1.5 μm or less.

As the resin fine particles, it is possible to use the ones obtained by emulsification polymerization of the same monomer as the polymerizable monomer to be use for the above polymer primary particles.

The resin fine particles are generally used in the form of a dispersion liquid as dispersed in water or a liquid containing water as the main component by means of a surfactant. When a charge controlling agent is added after the aggregation treatment, it is preferred to add the resin fine particles after adding the charge controlling agent to the dispersion liquid containing particle aggregates.

In order to increase the stability of the particle aggregates obtained in the aggregation process, it is preferred to perform fusion among aggregated particles in a aging process after the aggregation process. The temperature in the aging process is preferably Tg of the polymer primary particles or higher, more preferably (Tg+5)° C. or higher, and preferably (Tg+80)° C. or lower, more preferably (Tg+50)° C. or lower.

The time required for the aging process varies depending upon the objective shape of the toner, but it is generally preferred to maintain 0.1 to 10 hour, preferably 1 to 6 hours, after the temperature has reached the glass transition temperature of the polymer primary particles or higher.

Further, after the aggregation process, preferably at a stage before the aging process or during the aging process, it is preferred to add a surfactant, to raise the pH value, or to perform both of these methods in combination. As the surfactant to be used here, one or more kinds may be selected for use from the emulsifiers which can be used in the manufacture of the polymer primary particles, but it is especially preferred to use the same emulsifier as used for the manufacture of the polymer primary particles.

In the case of adding the surfactant, the addition amount is not especially restricted, but is preferably 0.1 parts by mass or more based on 100 parts by mass of the solid components in the mixed dispersion liquid, more preferably 0.3 parts by mass or more, still more preferably 1 part by mass or more, most preferably 3 parts by mass or more, and preferably 20 parts by mass or less, more preferably 15 parts by mass or less, still more preferably 10 parts by mass or less. By adding the surfactant or raising the pH value during the period after the aggregation process and before completion of the aging process, it may be possible to suppress aggregation of the aggregates of particles which are aggregated in the aggregation process and to suppress formation of coarse particles after the aging process.

By heat treatment in the aging process, fusing and integration among the polymer primary particles are performed in the aggregates, and the shape of the toner particles as the aggregates becomes close to a spherical shape. The particle aggregates before the aging process are considered to be agglomerates by electrostatic or physical aggregation of the polymer primary particles, but after the aging process, the polymer primary particles constituting the particle aggregates are considered to be mutually fused, and it becomes possible to make the shapes of the toner particles close to a spherical shape.

According to such an aging process, by controlling the temperature, time, and the like of the aging process, it is possible to manufacture toners having various shapes depending upon the purpose, e.g., a grape type having a shape of aggregation of polymer primary particles, a potato type having a shape of advanced fusion, and a spherical type having a shape of further advanced fusion.

The toner mother particles manufactured by a polymerization method are separated from the aqueous solvent, washed and dried, and if necessary, subjected to external addition treatment and the like, and used as an electrostatic image developing toner.

Water is employed as the liquid to be used for washing, but it is also possible to perform washing with an aqueous solution of an acid or alkali. Alternatively, washing may be carried out with warm water or hot water, and these methods may be used in combination. By going through such a washing process, it is possible to reduce or remove the suspended stabilizer, emulsifier, unreacted remaining monomers and the like, and so preferred. In the washing process, it is preferred to repeat operations of subjecting the liquid to be washed to filtration or decantation to obtain a concentrated slurry or wet cake of colored particles, to which adding a fresh washing liquid to disperse the toner mother particles. The colored particles after washing are preferably recovered in a state of a wet cake in view of handling efficiency in the subsequent drying process.

In the drying process, a fluidized drying method such as a vibration type fluidized drying method or a circulation type fluidized method, a flash drying method, a vacuum drying method, a freeze drying method, a spray drying method, or a flash jet method may be used. The operation conditions such as the temperature, air flow, the degree of vacuum, and the like in the drying process are arbitrarily optimized based on Tg of the colored particles, the shape, mechanism, size, and the like of the apparatus.

The volume average particle size of the electrostatic image developing toner according to the invention is preferably 3 μm or more, more preferably 5 μm or more, and is preferably 15 μm or less, more preferably 10 μm or less.

With respect to the shape, the average circularity as measured by means of a flow type particle image analyzer FPIA-3000 is preferably 0.90 or more, more preferably 0.92 or more, still more preferably 0.94 or more, and is preferably 0.99 or less. When the average circularity is too low, there is a case where lowering of the image density is liable to be caused by deterioration in charging property due to poor attachment of the external additives to the colored particles, while when it is too high, there is a case where cleaning failure attributable to the shape of colored particles is liable to occur.

The glass transition temperature Tg by DSC method of the toner according to the invention is preferably 40° C. or more, more preferably 50° C. or more, and is preferably 80° C. or less, more preferably 70° C. or less. When the Tg is in the above range, the preservation stability and fixing property of the toner are preferably increased.

<External Additives (External Addition Fine Particles)>

From the viewpoint of charge controlling, it is preferred that electrically conductive fine particles are added to the toner according to the invention as the external additive.

With respect to the resistance of electrically conductive fine particles, the least upper bound is generally 400 Ω·cm or less, preferably 200 Ω·cm or less, more preferably 100 Ω·cm or less, and still more preferably 60 Ω·cm or less. On the other hand, the greatest lower bound is generally 0.1 Ω·cm or more, preferably 1 Ω·cm or more, more preferably 5 Ω·cm or more, and still more preferably 15 Ω·cm or more.

The examples of electrically conductive fine particles include, for example, metal oxides, e.g., conductive titanium oxide and magnetite, conductive titanium oxide and magnetite doped with a conductive material, organic fine particles obtained by doping a polymer having a conjugate double bond, e.g., polyacetylene, polyphenylacetylene, poly-p-phenylene, and the like with a conductive material such as a metal, and carbons typified by carbon black and graphite. Of these electrically conductive fine particles, conductive titanium oxide and conductive titanium oxide doped with a conductive material are more preferred in view of capable of imparting electric conductivity without impairing the flowability of the toner.

With respect to the content of the electrically conductive fine particles, the greatest lower bound is generally 0.05 parts by mass or more per 100 parts by mass of the toner mother particles, preferably 0.1 parts by mass or more, and more preferably 0.2 parts by mass or more. On the other hand, the least upper bound of the content of the electrically conductive fine particles is generally 3 parts by mass or less, preferably 2 parts by mass or less, and more preferably 1 part by mass or less.

Further, when conductive titanium oxide is used as the conductive fine particles, the greatest lower bound is preferably 0.05 parts by mass or more per 100 parts by mass of the toner mother particles, and more preferably 0.1 parts by mass or more. The least upper bound is preferably 3 parts by mass or less, and more preferably 2 parts by mass or less.

For the purpose of the improvement of the flowability of toner and the improvement of the charge controlling property, if necessary, external addition fine particles other than the above electrically conductive fine particles may be added as an external additive. Such external addition fine particles can be arbitrarily selected for use from among various inorganic and organic fine particles.

The examples of inorganic fine particles which can be used in the invention include various kinds of carbides, such as silicon carbide, boron carbide, titanium carbide, zirconium carbide, hafnium carbide, vanadium carbide, tantalum carbide, niobium carbide, tungsten carbide, chromium carbide, molybdenum carbide, calcium carbide, and the like, various kinds of nitrides, such as boron nitride, titanium nitride, zirconium nitride, and the like, various kinds of boride, such as zirconium boride and the like, various kinds of oxides, such as titanium oxide, calcium oxide, magnesium oxide, zinc oxide, copper oxide, aluminum oxide, cerium oxide, silica, colloidal silica, and the like, various kinds of titanic acid compounds, such as calcium titanate, magnesium titanate, strontium titanate, and the like, phosphoric acid compound such as calcium phosphate and the like, sulfide such as molybdenum disulfide and the like, fluoride such as magnesium fluoride, carbon fluoride, and the like, stearic acid compounds such as aluminum stearate, calcium stearate, zinc stearate, magnesium stearate, and the like, other various kinds of metal soaps, talc, bentonite, various kinds of carbon blacks, conductive carbon black, magnetite, ferrite, and the like.

As organic fine particles, fine particles of styrene resin, acryl resin, epoxy resin, melamine resin and the like can be used.

Of these external addition fine particles, silica, titanium oxide, alumina, zinc oxide, various kinds of carbon blacks and electrically conductive carbon blacks are especially preferably used, above all, silica is preferred in view of the manufacturing property of inorganic particles, and the flowability, charging property and preservation stability of the toner.

Further, as the external addition fine particles, it is also possible to use the above inorganic or organic fine particles having been subjected to surface treatment, e.g., hydrophobitizing treatment, with a treating agent, for example, a silane coupling agent such as hexamethyldisilazane (HMDS), dimethyldichlorosilane (DMDS) and the like, a titanate coupling agent, a silicone oil treating agent, such as silicone oil, dimethyl silicone oil, modified silicone oil, amino-modified silicone oil, and the like, silicone varnish, a fluorine-based silane coupling agent, fluorine-based silicone oil, a coupling agent having an amino group or a quaternary ammonium salt group, and the like.

These treating agents may be used in combination of two or more kinds. In particular, positively charging inorganic particles having been treated with an amino group-containing compound are preferably used in view of capable of sufficiently obtaining a positively charging property. The external addition fine particles having been subjected to surface treatment such as hydrophobitizing treatment with a coupling agent having an amino group or a quaternary ammonium salt group and the like are especially preferred. The reason for this fact is not clearly known, but it is presumed that stabilization effect is brought about by the interaction between the ether bond present in the vicinity of the surfaces of toner mother particles and the hydrogen bond of an amino group or a quaternary ammonium salt group present in the vicinity of the surface of the external additive.

When the above external addition fine particles are used in the invention, the average particle size of the external addition fine particles is generally preferably 0.001 μm or more, more preferably 0.005 μm or more, and preferably 3 μm or less, more preferably 1 μm or less. It is also possible to blend two or more kinds of external addition fine particles each having a different particle size. The average particle size of external addition fine particles can be found by observation with an electron microscope.

Two or more kinds of different external addition fine particles may also be used in combination, that is, those having been subjected to surface treatment and not subjected to surface treatment may be used in combination, those having been subjected to different surface treatments may be used in combination, or positively charging and negatively charging external addition fine particles may be used in optional combination.

When the external addition fine particles other than the electrically conductive fine particles are used in the invention, the content of the external addition fine particles is preferably 0.01 parts by mass or more per 100 parts by mass of the toner mother particles, more preferably 0.1 parts by mass or more, still more preferably 0.5 parts by mass or more, most preferably 0.8 parts by mass or more, and is preferably 5 parts by mass or less, more preferably 4 parts by mass or less.

Further, inorganic fine powders, such as magnetite, ferrite, cerium oxide, strontium titanate, conductive titania and the like may be added. The amount to be used of these additives may be optionally selected depending upon the desired performance, and is preferably 0.05 parts by mass or more and 10 parts by mass or less per 100 parts by mass of the toner mother particles.

By adopting silica as the external additive for use in combination with electrically conductive fine particles, and by selecting the kind, addition amount and addition method thereof, the performance of the toner, especially the charging property of the toner, and the performances of the particles such as blocking resistance and flowability can be preferably controlled. Further, to take the balance of each performance, it is more preferred to use two or more kinds of silica in combination.

In the invention, by the presence of silica A having a volume average primary particle size of 5 nm or more and 15 nm or less and silica B having a volume average primary particle size larger than that of silica A by 5 nm or more on the surfaces of the toner mother particles, characteristics of the particles such as the charging property, blocking resistance and flowability can be controlled.

The greatest lower bound of the volume average primary particle size of silica A is generally 5 nm or more, and preferably 6 nm or more. On the other hand, the least upper bound is generally 15 nm or less, and preferably 13 nm or less.

Silica B is not especially restricted so long as it is larger than silica A in the volume average primary particle size by 5 nm or more, and is preferably larger than silica A by 10 nm or more. On the other hand, from the viewpoint of capable of improving the balance of the charging property, blocking resistance and flowability, the least upper bound of the difference in volume average primary particle size of silica B and silica A is generally 150 nm or less, preferably 100 nm or less, more preferably 50 nm or less, and especially preferably 25 nm or less.

As silica A and silica B, specifically it is also possible to use silica having been subjected to surface treatment, e.g., hydrophobitizing treatment, with a treating agent, for example, a silane coupling agent such as hexamethyldisilazane (HMDS), dimethyldichlorosilane (DMDS) and the like, a titanate coupling agent, a silicone oil treating agent, such as silicone oil, dimethyl silicone oil, modified silicone oil, amino-modified silicone oil, and the like, silicone varnish, a fluorine-based silane coupling agent, fluorine-based silicone oil, a coupling agent having an amino group or a quaternary ammonium salt group, and the like. These treating agents may be used in combination of two or more kinds. In particular, positively charging inorganic particles having been treated with an amino group-containing compound are preferably used in view of capable of sufficiently obtaining a positively charging property. Those having been subjected to surface treatment such as hydrophobitizing treatment with a coupling agent having an amino group or a quaternary ammonium salt group and the like are especially preferred.

When silica A and silica B are used as external additives, the greatest lower bound of the addition amount of silica A is generally 0.1 parts by mass or more per 100 parts by mass of the toner mother particles, preferably 0.2 parts by mass or more, more preferably 1.0 part by mass or more, and still more preferably 1.5 parts by mass or more. On the other hand, the least upper bound thereof is generally 5 parts by mass or less, and preferably 4 parts by mass or less.

With respect to silica B, the greatest lower bound of the addition amount is generally 0.1 parts by mass or more per 100 parts by mass of the toner mother particles, preferably 0.2 parts by mass or more, more preferably 0.5 part by mass or more, and still more preferably 0.8 parts by mass or more. On the other hand, the least upper bound thereof is generally 5 parts by mass or less, preferably 4 parts by mass or less, and more preferably 2 parts by mass or less.

In the invention, by further external addition of fine particles containing a fluorine atom onto the surfaces of toner mother particles, charging stability can be improved.

<Method of External Addition of External Additive (External Addition Fine Particles)>

As the method of adding the external addition fine particles, a method of using a high speed stirrer such as HENSCHEL MIXER, or a method of using a device capable of applying a compression shearing stress are exemplified.

An external addition toner can be manufactured by one step external addition of adding all the external additives simultaneously, but it can also be manufactured by a method of external addition in a separate step with every external additive.

For preventing the temperature rising at the time of external addition, it is preferred to equip the reaction vessel with a cooling device, or to perform external addition in a separate step.

When the above-described two kinds of silica A and silica B are used as the external addition fine particles, the method of external addition is not especially restricted, but from the point of preventing the temperature rising, the method of external addition in a separate step is preferred.

In the method of external addition in a separate step, the order of the addition of two kinds of silica A and silica B is not particularly limited, but from the point of the strength of attachment of the external addition fine particles onto the surfaces of the toner mother particles, it is preferred to externally add silica A after silica B has been externally added, and especially preferably silica B is externally added in the first step and silica A is externally added in the final step.

When the electrically conductive fine particles are externally added by the method of external addition in a separate step, it is preferred for the conductive fine particles to be externally added in the first step, and when the conductive fine particles are used in combination with silica A and silica B, it is preferred for the conductive fine particles to be externally added in the first step together with silica B.

<Others>

The electrostatic image developing toner according to the invention may be used in the form of a two-component type developer wherein the toner is used together with a carrier, or in the form of a magnetic or non-magnetic one-component type developer wherein a carrier is not used.

When the toner is used as the two-component type developer, as the carrier, it is possible to use known carriers, e.g., magnetic materials, such as iron powder, magnetite powder, ferrite powder, and the like, these magnetic materials the surfaces of which are coated with a resin coating, a magnetic carrier, and the like. As a coating resin for a resin-coated carrier, commonly known styrene resins, acrylic resins, styrene-acryl copolymer resins, silicone resins, modified silicone resins, fluorine resins, and mixtures of these resins can be utilized.

EXAMPLE

The invention will be described more specifically with reference to examples, but the invention is by no means restricted thereto so long as it does not exceed the scope thereof. In the examples "parts" means "parts by mass" unless otherwise indicated.

A particle size, the degree of circularity, electric conductivity and thermal characteristics are measured as follows.

<Measurement of Volume Average Particle Size (MV)>

The volume average particle size (MV) of a particle having a volume average particle size (MV) of less than 1 μm was measured by means of Microtrac Nanotrac 150 (hereinafter abbreviated to Nanotrac) (manufactured by Nikkiso Co., Ltd.) and an analyzing software Microtrac Particle Analyzer Ver 10.1.2-019EE (manufactured by the same company) by the method described in the handling manual, by using ion exchange water having an electric conductivity of 0.5 μS/cm as the solvent, on the measuring conditions of solvent refractive index: 1.333, measuring time: 600 sec., and measuring number of time: one time. Other conditions were set as particle refractive index: 1.59, permeability: permeable, shape: spherical, and density: 1.04.

<Measurement of Volume Median Particle Size (Dv50)>

The volume median particle size (Dv50) of particles having a volume median particle size of 1 μm or more was measured by means of Multisizer III (aperture diameter: 100 μm, hereinafter abbreviated to Multisizer, manufactured by Beckman Coulter, Inc.) by using Isoton II (manufactured by the same company) as the dispersion medium, and dispersing the particles so that the dispersoid concentration became 0.03%.

<Measurement of Degree of Average Circularity>

The degree of average circularity was measured by dispersing the dispersoid in a dispersion medium (Cellsheath, manufactured by Sysmex Co.) so that the concentration became in the range of 5,720 to 7,140 particles/μL, and using a flow type particle analyzer (FPIA3000, manufactured by Sysmex Co.) on the condition of HPF analytical amount: 0.35 μL and HPF detection number: 2,000 to 2,500 particles, and the measurement was performed by the HPF mode.

<Measurement of Electric Conductivity>

Electric conductivity was measure with a conductivity meter (Cyber Scan CON 100, manufactured by AS ONE Corporation).

<Weight Average Molecular Weight (Mw)>

A tetrahydrofuran (THF)-soluble component of the dispersion liquid of polymer primary particles was measured by gel permeation chromatography (GPC) on the following conditions:

Apparatus: GPC apparatus HLC-8020 (manufactured by Tosoh Corporation)

Column: PL-gel Mixed-B10 μm (manufactured by Polymer Laboratory)

Solvent: THF

Sample concentration: 0.1% by weight

Calibration curve: standard polystyrene

<Polymerization Stability>

Attachment to the wall of the vessel and the influence on stirring by precipitation or the like were evaluated at the time of manufacturing the dispersion liquid of polymer primary particles.

◎: Free from attachment and precipitation

○: Attachment and precipitation were observed a little.

x: A lot of attachment and precipitation were observed.

<Aggregation Stability>

Aggregation stability was evaluated from the difficulties in the control of the size and shape of particles in manufacturing toner mother particles by aggregating polymer primary particles.

◎: The size and shape can be controlled.

○: The size and shape can be controlled to a certain degree.

x: The size and shape cannot be controlled.

Example 1-a

<Preparation of Wax Dispersion Liquid A1-a>

Paraffin was (100 parts) (NHP-9, melting temperature: 82° C., manufactured by Nippon Seiro Co., Ltd.), 6.91 parts of stearyl acrylate, 3.3 parts of decaglycerin decabehenate (acid value: 3.2, hydroxyl group value: 27), 7.1 parts of a 20% sodium dodecylbenzenesulfonate aqueous solution (Neogen S20D, manufactured by DAI-ICHI KOGYO SEIYAKU CO., LTD., hereinafter abbreviated to a 20% DBS aqueous solution), and 255.9 parts of desalted water were heated at 90° C. and stirred for 10 minutes by means of a homomixer (Model Mark IIf, manufactured by Tokushu Kika Kogyo Co., Ltd.). Subsequently, circulation emulsification was initiated under heating at 90° C. with a high pressure emulsification equipment on a pressure condition of 20 MPa, and the particle size was measured by Nanotrac. The particles were dispersed until the volume average particle size (MV) became 500 nm or less to thereby obtain emulsified liquid A1-a. The final particle size (MV) was 230 nm.

<Preparation of Polymer Primary Particle Dispersion Liquid B1-a>

A reaction vessel equipped with a stirring device (three blades), a heating/cooling device, a concentrating device, and a for stocking various materials and additives was charged with 36.7 parts of wax dispersion liquid A1 and 263 parts of desalted water, and the temperature was raised to 90° C. under nitrogen flow with stirring.

After that, while continuing stirring, a mixture of the following monomers and emulsifier aqueous solution was added to the above reaction system over 4 hours. The time when the dropping of the mixture of monomers and emulsifier aqueous solution was initiated was taken as the initiation time of polymerization, and addition of the following initiator aqueous solution 1-a was initiated at the same time with the initiation time of polymerization and addition was continued over 4 hours, and initiator aqueous solution 2-a was added for further 1 hour. After that, the reaction system was retained for 1 hour under stirring while maintaining the inner temperature at 90° C.

[Monomers]

| | |
|---|---|
| Styrene | 81.3 parts |
| Butyl acrylate | 18.7 parts |
| Methoxypolyethylene glycol monomethacrylate $CH_2{=}C(CH_3)COO(C_2H_4O)_nCH_3$ (n = 8.5) (ME-40, manufactured by Toho Chemical Industry Co., Ltd.) | 4.00 parts |
| Trichlorobromomethane | 1.0 part |

[Emulsifier Aqueous Solution]

| | |
|---|---|
| 20% DBS aqueous solution | 1.0 part |
| Desalted water | 68.3 parts |

[Initiator Aqueous Solution 1-a]

| | |
|---|---|
| 8% Hydrogen peroxide aqueous solution | 15.5 parts |
| 8% L-(+) Ascorbic acid aqueous solution | 15.5 parts |

[Initiator Aqueous Solution 2-a]

| | |
|---|---|
| 8% L-(+) Ascorbic acid aqueous solution | 14.2 parts |

The reaction solution was cooled after termination of the polymerization reaction to obtain milky white polymer primary particle dispersion liquid B1-a. The volume average particle size (MV) of polymer primary particle dispersion liquid B1-a measured by using Nanotrac was 220 nm. The average molecular weight (Mw) was 53,000.

[Manufacture of Toner Mother Particles C1-a]

A mixer equipped with a stirring device (double helical blades), a heating/cooling device, a concentrating device, and a device for stocking various materials and additives was charged with 100 parts (solid content) of polymer primary particle dispersion liquid B1 at room temperature (about 25° C.). Thereafter, 4.4 parts (solid content) of a cyan pigment dispersion liquid (EP700, manufactured by Dainichiseika Color & Chemicals Mfg. Co., Ltd.) was added thereto over 5 minutes and uniformly mixed, followed by dropping of 1.4 parts (solid content) of a 1N HCl solution. After that, the inner temperature was raised to 62° C. over 150 minutes. Here, the volume median particle size (Dv50) was measured by means of Multisizer, and 0.5 parts (solid content) of a 20% DBS aqueous solution was added and the temperature was raised to 85° C. over 30 minutes. Further, 2.4 parts (solid content) of a 1N NaOH solution was added thereto and the temperature was raised to 97° C. and the reaction system was retained for 240 minutes.

After that, the system was cooled to 30° C. over 20 minutes, and the obtained slurry was taken out and subjected to suction filtration by means of an aspirator using a filter paper No. 5C (manufactured by Toyo Roshi Kaisha, Ltd.). The cake remained on the filter paper was transferred to a stainless steel container equipped with a stirring device (propeller blades), and ion exchange water having an electric conductivity of 1 μS/cm was added thereto, followed by stirring at 50 rpm for 30 minutes for uniform dispersion.

Thereafter, suction filtration was performed again by means of an aspirator using a filter paper No. 5C, and the solid remained on the filter paper was again transferred to a stainless steel container equipped with a stirring device (propeller blades) containing ion exchange water having an electric conductivity of 1 μS/em, followed by stirring at 50 rpm for 30 minutes for uniform dispersion. This process was repeated three times, whereby the electric conductivity of the filtrate became 2 μS/cm.

The thus-obtained cake was dried in a air-blowing dryer set at 40° C. for 48 hours to thereby obtain toner mother particles C1-a.

The volume median particle size (Dv50) of toner mother particles C1-a measured by means of Multisizer III was 7.2 μm, and the degree of average circularity measured with a flow type particle analyzer was 0.98.

[Manufacture of Toner D1-a for Development]

Toner mother particles C1-a (100 parts) was put into Sample Mill LSMK (manufactured by AS ONE Corporation), subsequently 0.5 parts of silica fine particles having been subjected to hydrophobitization treatment with aminosilane and having a volume average primary particle size of 0.03 μm was added thereto and the system was stirred for 2 minutes in total and mixed. After that, 1.0 part of silica fine particles having been subjected to hydrophobitization treatment with aminosilane and having a volume average primary particle size of 0.01 μm was added thereto and the system was stirred for 2 minutes in total and mixed. By sieving the mixture, toner D1-a for development was obtained.

Example 2-a

<Preparation of Polymer Primary Particle Dispersion Liquid B2-a>

Polymer primary particle dispersion liquid B2-a was obtained in the same manner as in the manufacture of B1-a except for changing the monomers as shown below. The volume average particle size (MV) was 220 nm and the average molecular weight (Mw) was 65,000.

[Monomers]

| | |
|---|---|
| Styrene | 81.3 parts |
| Butyl acrylate | 18.7 parts |
| Methoxypolyethylene glycol monomethacrylate $CH_2{=}C(CH_3)COO(C_2H_4O)_nCH_3$ (n = 8.5) (ME-40, manufactured by Toho Chemical Industry Co., Ltd.) | 5.17 parts |
| Trichlorobromomethane | 1.0 part |

[Manufacture of Toner Mother Particles C2-a]

Toner mother particles C2-a was obtained in the same manner as in the manufacture of C1-a except for using polymer primary particle dispersion liquid B2-a in place of B1-a and changing the temperature rising process to 100 minutes at 58° C., and the retaining time at 97° C. to 60 minutes. The volume median particle size (Dv50) was 6.4 μm, and the degree of average circularity measured with a flow type particle analyzer was 0.97.

[Manufacture of Toner D2-a for Development]

Toner D2-a for development was obtained in the same manner as in the manufacture of D1-a except for using toner mother particles C2-a in place of C1-a.

Example 3-a

<Preparation of Polymer Primary Particle Dispersion Liquid B3-a>

Polymer primary particle dispersion liquid B3-a was obtained in the same manner as in the manufacture of B1-a except for changing the monomers as shown below. The volume average particle size (MV) was 220 nm and the average molecular weight (Mw) was 65,000.

[Monomers]

| | |
|---|---|
| Styrene | 81.3 parts |
| Butyl acrylate | 18.7 parts |
| Methoxypolyethylene glycol monomethacrylate $CH_2{=}C(CH_3)COO(C_2H_4O)_nCH_3$ (n = 8.5) (ME-40, manufactured by Toho Chemical Industry Co., Ltd.) | 5.17 parts |
| Trichlorobromomethane | 1.0 part |
| Hexanediol diacrylate | 0.2 parts |

[Manufacture of Toner Mother Particles C3-a]

Toner mother particles C3-a was obtained in the same manner as in the manufacture of C1-a except for using polymer primary particle dispersion liquid B3-a in place of B1-a and changing the temperature rising process to 120 minutes at 62° C., and the retaining time at 97° C. to 240 minutes. The volume median particle size (Dv50) was 6.4 μm, and the degree of average circularity measured with a flow type particle analyzer was 0.97.

[Manufacture of Toner D3-a for Development]

Toner D3-a for development was obtained in the same manner as in the manufacture of D1-a except for using toner mother particles C3-a in place of C1-a.

Example 4-a

<Preparation of Polymer Primary Particle Dispersion Liquid B4-a>

Polymer primary particle dispersion liquid B4-a was obtained in the same manner as in the manufacture of B1-a except for changing the monomers as shown below. The volume average particle size (MV) was 220 nm and the average molecular weight (Mw) was 53,000.

[Monomers]

| | |
|---|---|
| Styrene | 76.8 parts |
| Butyl acrylate | 23.2 parts |
| Methoxypolyethylene glycol monomethacrylate $CH_2{=}C(CH_3)COO(C_2H_4O)_nCH_3$ (n = 9) (PME-400, manufactured by Nippon Oils and Fats Co., Ltd.) | 10.33 parts |
| Trichlorobromomethane | 1.0 part |

[Manufacture of Toner Mother Particles C4-a]

Toner mother particles C4-a was obtained in the same manner as in the manufacture of C1-a except for using polymer primary particle dispersion liquid B4-a in place of B1-a and changing the temperature rising process to 120 minutes at 83° C., and the retaining time at 97° C. to 70 minutes. The volume median particle size (Dv50) was 10 μm, and the degree of average circularity measured with a flow type particle analyzer was 0.90.

[Manufacture of Toner D4-a for Development]

Toner D4-a for development was obtained in the same manner as in the manufacture of D1-a except for using toner mother particles C4-a in place of C1-a.

Example 5-a

<Preparation of Polymer Primary Particle Dispersion Liquid B5-a>

Polymer primary particle dispersion liquid B5-a was obtained in the same manner as in the manufacture of B1-a except for changing the monomers as shown below. The volume average particle size (MV) was 170 nm and the average molecular weight (Mw) was 42,000.

[Monomers]

| | |
|---|---|
| Styrene | 81.3 parts |
| Butyl acrylate | 18.7 parts |
| Methoxypolyethylene glycol monomethacrylate $CH_2{=}C(CH_3)COO(C_2H_4O)_nCH_3$ (n = 4) (PME200, manufactured by Nippon Oils and Fats Co., Ltd.) | 10.0 parts |
| Trichlorobromomethane | 1.0 part |

[Manufacture of Toner Mother Particles C5-a]

Toner mother particles C5-a was obtained in the same manner as in the manufacture of C1-a except for using polymer primary particle dispersion liquid B5-a in place of B1-a, and changing the 1N HCl solution to 0.8 parts (solid content), the temperature rising process to 30 minutes at 50° C., and the retaining time at 90° C. to 10 minutes. The volume median particle size (Dv50) was 10 μm, and the degree of average circularity measured with a flow type particle analyzer was 0.97.

[Manufacture of Toner D5-a for Development]

Toner D5-a for development was obtained in the same manner as in the manufacture of D1-a except for using toner mother particles C5-a in place of C1-a.

Example 6

<Preparation of Polymer Primary Particle Dispersion Liquid B6-a>

Polymer primary particle dispersion liquid 136-a was obtained in the same manner as in the manufacture of B1-a except for changing the monomers as shown below. The volume average particle size (MV) was 170 nm and the average molecular weight (Mw) was 49,000.

[Monomers]

| | |
|---|---|
| Styrene | 81.3 parts |
| Butyl acrylate | 18.7 parts |
| Methoxypolyethylene glycol monomethacrylate $CH_2{=}C(CH_3)COO(C_2H_4O)_nCH_3$ (n = 5.2) (ME-30, manufactured by Toho Chemical Industry Co., Ltd.) | 5.17 parts |
| Trichlorobromomethane | 1.0 part |

[Manufacture of Toner Mother Particles C6-a]

Toner mother particles C6-a was obtained in the same manner as in the manufacture of C1-a except for using polymer primary particle dispersion liquid B6-a in place of B1-a, and changing the temperature rising process to 100 minutes at 57° C., and the retaining time at 97° C. to 20 minutes. The volume median particle size (Dv50) was 8.0 μm, and the degree of average circularity measured with a flow type particle analyzer was 0.97.

[Manufacture of Toner D6-a for Development]

Toner D6-a for development was obtained in the same manner as in the manufacture of D1-a except for using toner mother particles C6-a in place of C1-a.

Example 7

<Preparation of Polymer Primary Particle Dispersion Liquid B7-a>

Polymer primary particle dispersion liquid B7-a was obtained in the same manner as in the manufacture of B1-a except for changing the monomers as shown below. The volume average particle size (MV) was 220 nm and the average molecular weight (Mw) was 46,000.

[Monomers]

| | |
|---|---|
| Styrene | 81.3 parts |
| Butyl acrylate | 18.7 parts |
| Octyl polyethylene glycol polypropylene glycol methacrylate $CH_2{=}C(CH_3)COO(C_2H_4O)_X(C_3H_6O)_YC_8H_{17}$ (X = 8, Y = 6) (50POEP-800B, manufactured by Nippon Oils and Fats Co., Ltd.) | 5.0 parts |
| Trichlorobromomethane | 1.0 part |
| Hexanediol diacrylate | 0.2 parts |

[Manufacture of Toner Mother Particles C7-a]

Toner mother particles C7-a was obtained in the same manner as in the manufacture of C1-a except for using polymer primary particle dispersion liquid B7-a in place of B1-a, and changing the 1N HCl solution to 1.5 parts (solid content), the temperature rising process to 120 minutes at 55° C., and the retaining time at 97° C. to 40 minutes. The volume median particle size (Dv50) was 6.5 μm, and the degree of average circularity measured with a flow type particle analyzer was 0.99.

[Manufacture of Toner D7-a for Development]

Toner D7-a for development was obtained in the same manner as in the manufacture of D1-a except for using toner mother particles C7-a in place of C1-a.

Comparative Example 1-a

<Preparation of Polymer Primary Particle Dispersion Liquid B8-a>

A reaction vessel equipped with a stirring device (three blades), a heating/cooling device, a concentrating device, and a for stocking various materials and additives was charged with 36 parts of wax dispersion liquid A1-a and 226 parts of desalted water, and the temperature was raised to 90° C. under nitrogen flow with stirring.

After that, while continuing stirring, a mixture of the following monomers and emulsifier aqueous solution was added to the above reaction system over 5 hours. The time when the dropping of the mixture of monomers and emulsifier aqueous solution was initiated was taken as the initiation time of polymerization, and addition of the following initiator aqueous solution 1-a was initiated after 30 minutes from the initiation time of polymerization and addition was continued over 4.5 hours, and initiator aqueous solution 2-a was added for further 2 hours. After that, the reaction system was retained for 1 hour under stirring while maintaining the inner temperature at 90° C.

[Monomers]

| | |
|---|---|
| Styrene | 76.3 parts |
| Butyl acrylate | 23.7 parts |
| Acrylic acid | 1.5 parts |
| Hexanediol diacrylate | 0.7 parts |
| Trichlorobromomethane | 1.0 part |

[Emulsifier Aqueous Solution]

| | |
|---|---|
| 20% DBS aqueous solution | 1.0 part |
| Desalted water | 67.1 parts |

[Initiator Aqueous Solution 1-a]

| | |
|---|---|
| 8% Hydrogen peroxide aqueous solution | 17.2 parts |
| 8% L-(+) Ascorbic acid aqueous solution | 17.2 parts |

[Initiator Aqueous Solution 2-a]

| | |
|---|---|
| 8% L-(+) Ascorbic acid aqueous solution | 14.2 parts |

The reaction solution was cooled after termination of the polymerization reaction to obtain milky white polymer primary particle dispersion liquid B8-a. The volume average particle size (MV) of polymer primary particle dispersion liquid B1-a was 240 nm. The average molecular weight (Mw) was 75,000.

[Manufacture of Toner Mother Particles C8-a]

Toner mother particles C8-a was obtained in the same manner as in the manufacture of C1-a except for using polymer primary particle dispersion liquid B8-a in place of B1-a, and changing the temperature rising process to 80 minutes at 58° C., and the retaining time at 97° C. to 90 minutes. The volume median particle size (Dv50) was 5.7 μm, and the degree of average circularity measured with a flow type particle analyzer was 0.97.

Comparative Example 2-a

<Preparation of Polymer Primary Particle Dispersion Liquid B9-a>

Polymer primary particle dispersion liquid B9-a was obtained in the same manner as in the manufacture of B1-a except for changing the monomers as shown below. The volume average particle size (MV) was 220 nm and the average molecular weight (Mw) was 109,000.

[Monomers]

| | |
|---|---|
| Styrene | 75.0 parts |
| 2-Ethoxyethyl monomethacrylate $CH_2{=}C(CH_3)COO(C_2H_4O)_nC_2H_5$ (n = 1) (manufactured by Tokyo Chemical Industry Co., Ltd.) | 25.0 parts |
| Trichlorobromomethane | 1.0 part |
| Hexanediol diacrylate | 0.7 parts |

[Manufacture of Toner Mother Particles C9-a]

Manufacture of toner mother particles C9-a was performed in the same manner as in the manufacture of C1-a except for using polymer primary particle dispersion liquid B9-a in place of B1-a, but the particle size of the aggregated particles could not be controlled and the toner mother particles could not be obtained.

Comparative Example 3-a

<Preparation of Polymer Primary Particle Dispersion Liquid B10-a>

Polymer primary particle dispersion liquid B10-a was obtained in the same manner as in the manufacture of B1-a except for changing the monomers as shown below. The volume average particle size (MV) was 210 nm and the average molecular weight (Mw) was 32,000.

[Monomers]

| | |
|---|---|
| Styrene | 76.8 parts |
| Butyl acrylate | 23.2 parts |
| Methoxypolyethylene glycol monomethacrylate $CH_2{=}C(CH_3)COO(C_2H_4O)_nCH_3$ (n = 2) (PME100, manufactured by Nippon Oils and Fats Co., Ltd.) | 1.8 parts |
| Trichlorobromomethane | 1.0 part |

[Manufacture of Toner Mother Particles C10-a]

Manufacture of toner mother particles C10-a was performed in the same manner as in the manufacture of C1-a except for using polymer primary particle dispersion liquid B10-a in place of B1-a, but the particle size of the aggregated particles could not be controlled and the toner mother particles could not be obtained.

Comparative Example 4-a

<Preparation of Polymer Primary Particle Dispersion Liquid B11-a>

Polymer primary particle dispersion liquid B11-a was obtained in the same manner as in the manufacture of B1-a except for changing the monomers as shown below. The volume average particle size (MV) was 230 nm and the average molecular weight (Mw) was 46,000.

[Monomers]

| | |
|---|---|
| Styrene | 76.8 parts |
| Butyl acrylate | 23.2 parts |
| Methoxypolyethylene glycol monomethacrylate $CH_2{=}C(CH_3)COO(C_2H_4O)_nCH_3$ (n = 23) (PME-100, manufactured by Nippon Oils and Fats Co., Ltd.) | 11.4 parts |
| Trichlorobromomethane | 1.0 part |

[Manufacture of Toner Mother Particles C11-a]

Manufacture of toner mother particles C11-a was performed in the same manner as in the manufacture of C1-a except for using polymer primary particle dispersion liquid B11-a in place of B1-a, but the particle size of the aggregated particles could not be controlled and the toner mother particles could not be obtained.

Comparative Example 5-a

<Preparation of Polymer Primary Particle Dispersion Liquid B12-a>

Polymer primary particle dispersion liquid B12-a was obtained in the same manner as in the manufacture of B1-a except for changing the monomers as shown below. The volume average particle size (MV) was 220 nm and the average molecular weight (Mw) was 54,000.

[Monomers]

| | |
|---|---|
| Styrene | 76.8 parts |
| Butyl acrylate | 23.2 parts |
| Methoxypolyethylene glycol monomethacrylate $CH_2{=}C(CH_3)COO(C_2H_4O)_nCH_3$ (n = 90) (MEMA4000, manufactured by Toho Chemical Industry Co., Ltd.) | 5.17 parts |
| Trichlorobromomethane | 1.0 part |

[Manufacture of Toner Mother Particles C12-a]

Manufacture of toner mother particles C12-a was performed in the same manner as in the manufacture of C1-a except for using polymer primary particle dispersion liquid B12-a in place of B1-a, but the particle size of the aggregated particles could not be controlled and the toner mother particles could not be obtained.

Comparative Example 6-a

<Preparation of Polymer Primary Particle Dispersion Liquid B13-a>

Polymer primary particle dispersion liquid B13-a was obtained in the same manner as in the manufacture of B1-a except for changing the monomers as shown below. The volume average particle size (MV) was 170 nm and the average molecular weight (Mw) was 214,000.

[Monomers]

| | |
|---|---|
| Styrene | 90.7 parts |
| Butyl acrylate | 9.3 parts |
| Methoxypolyethylene glycol monomethacrylate $CH_2{=}C(CH_3)COO(C_2H_4O)_nCH_3$ (n = 2) (PME-100, manufactured by Nippon Oils and Fats Co., Ltd.) | 15.0 parts |
| Trichlorobromomethane | 1.0 part |
| Hexanediol diacrylate | 0.2 parts |

[Manufacture of Toner Mother Particles C13-a]

Manufacture of toner mother particles C13-a was performed in the same manner as in the manufacture of C1-a except for using polymer primary particle dispersion liquid B13-a in place of B1-a, but the particle size of the aggregated particles could not be controlled and the toner mother particles could not be obtained.

Comparative Example 7-a

<Preparation of Polymer Primary Particle Dispersion Liquid B14-a>

Polymer primary particle dispersion liquid B14-a was obtained in the same manner as in the manufacture of B1-a except for changing the monomers as shown below. The volume average particle size (MV) was 190 nm and the average molecular weight (Mw) was 35,000.

[Monomers]

| | |
|---|---|
| Styrene | 81.3 parts |
| Butyl acrylate | 18.7 parts |
| Methoxypolyethylene glycol monomethacrylate $CH_2{=}C(CH_3)COO(C_2H_4O)_nCH_3$ (n = 8.5) (ME-40, manufactured by Toho Chemical Industry Co., Ltd.) | 15.0 parts |
| Trichlorobromomethane | 1.0 part |

[Manufacture of Toner Mother Particles C14-a]

Manufacture of toner mother particles C14-a was performed in the same manner as in the manufacture of C1-a except for using polymer primary particle dispersion liquid B14-a in place of B1-a, but the particle size of the aggregated particles could not be controlled and the toner mother particles could not be obtained.

Example 1-b

<Preparation of Wax Dispersion Liquid A1-b>

Paraffin was (100 parts) (NHP-9, melting temperature: 82° C., manufactured by Nippon Seiro Co., Ltd.), 6.91 parts of stearyl acrylate, 3.3 parts of decaglycerin decabehenate (acid value: 3.2, hydroxyl group value: 27), 7.1 parts of a 20% sodium dodecylbenzenesulfonate aqueous solution (Neogen S20D, manufactured by DAI-ICHI KOGYO SEIYAKU CO., LTD., hereinafter abbreviated to a 20% DBS aqueous solution), and 255.9 parts of desalted water were heated at 90° C. and stirred for 10 minutes by means of a homomixer (Model Mark IIf, manufactured by Tokushu Kika Kogyo Co., Ltd.). Subsequently, circulation emulsification was initiated under heating at 90° C. with a high pressure emulsification equipment on a pressure condition of 20 MPa, and the particle size was measured by Nanotrac. The particles were dispersed until the volume average particle size (MV) became 500 nm or less to thereby obtain emulsified liquid A1-b. The final particle size (MV) was 230 nm.

<Preparation of Polymer Primary Particle Dispersion Liquid B1-b>

A reaction vessel equipped with a stirring device (three blades), a heating/cooling device, a concentrating device, and a for stocking various materials and additives was charged with 36.8 parts of wax dispersion liquid A1-b and 263 parts of desalted water, and the temperature was raised to 90° C. under nitrogen flow with stirring.

After that, while continuing stirring, a mixture of the following monomers and emulsifier aqueous solution was added to the above reaction system over 4 hours. The time when the dropping of the mixture of monomers and emulsifier aqueous solution was initiated was taken as the initiation time of polymerization, and addition of the following initiator aqueous solution 1-b was initiated at the same time with the initiation time of polymerization and addition was continued over 4 hours, and initiator aqueous solution 2-b was added for further 1 hour. After that, the reaction system was retained for 1 hour under stirring while maintaining the inner temperature at 90° C.

[Monomers]

| | |
|---|---|
| Styrene | 81.3 parts |
| Butyl acrylate | 18.7 parts |
| Methoxypolyethylene glycol monomethacrylate $CH_2{=}C(CH_3)COO(C_2H_4O)_nCH_3$ (n = 8.5) (ME-40, manufactured by Toho Chemical Industry Co., Ltd.) | 5.17 parts |
| Trichlorobromomethane | 1.0 part |

[Emulsifier Aqueous Solution]

| | |
|---|---|
| 20% DBS aqueous solution | 1.0 part |
| Desalted water | 69.1 parts |

[Initiator Aqueous Solution 1-b]

| | |
|---|---|
| 8% Hydrogen peroxide aqueous solution | 15.5 parts |
| 8% L-(+) Ascorbic acid aqueous solution | 15.5 parts |

[Initiator Aqueous Solution 2-b]

| | |
|---|---|
| 8% L-(+) Ascorbic acid aqueous solution | 14.2 parts |

The reaction solution was cooled after termination of the polymerization reaction to obtain milky white polymer primary particle dispersion liquid B1-b. The volume average particle size (MV) of polymer primary particle dispersion liquid B1-b measured by using Nanotrac was 220 nm. The average molecular weight (Mw) was 53,000.

[Manufacture of Toner Mother Particles C1-b]

A mixer equipped with a stirring device (double helical blades), a heating/cooling device, a concentrating device, and a device for stocking various materials and additives was charged with 100 parts (solid content) of polymer primary particle dispersion liquid B1-b at room temperature (about 25° C.). Thereafter, 4.4 parts (solid content) of a cyan pigment dispersion liquid (EP700, manufactured by Dainichiseika Color & Chemicals Mfg. Co., Ltd.) was added thereto over 5 minutes and uniformly mixed, followed by dropping of 1.4 parts (solid content) of a 1N HCl solution. After that, the inner temperature was raised to 62° C. over 150 minutes. Here, the volume median particle size (Dv50) was measured by means of Multisizer, and 0.5 parts (solid content) of a 20% DBS aqueous solution was added and the temperature was raised to 85° C. over 30 minutes. Further, 2.4 parts (solid content) of a 1N NaOH solution was added thereto and the temperature was raised to 97° C. and the reaction system was retained for 240 minutes.

After that, the system was cooled to 30° C. over 20 minutes, and the obtained slurry was taken out and subjected to suction filtration by means of an aspirator using a filter paper No. 5C (manufactured by Toyo Roshi Kaisha, Ltd.). The cake remained on the filter paper was transferred to a stainless steel container equipped with a stirring device (propeller blades), and ion exchange water having an electric conductivity of 1 μS/cm was added thereto, followed by stirring at 50 rpm for uniform dispersion. Thereafter, stirring was continued for 30 minutes.

Thereafter, suction filtration was performed again by means of an aspirator using a filter paper No. 5C, and the solid remained on the filter paper was again transferred to a stainless steel container equipped with a stirring device (propeller blades) containing ion exchange water having an electric conductivity of 1 μS/cm, followed by stirring at 50 rpm for uniform dispersion. Thereafter, stirring was continued for 30 minutes. This process was repeated three times, whereby the electric conductivity of the filtrate became 2 μS/cm.

The thus-obtained cake was dried in a air-blowing dryer set at 40° C. for 48 hours to thereby obtain toner mother particles C1-b.

The volume median particle size (Dv50) of toner mother particles C1-b measured by means of Multisizer III was 5.5 μm, and the degree of average circularity measured with a flow type particle analyzer was 0.97.

[Manufacture of Toner D1-b for Development]

Toner mother particles C1-b (100 parts) was put into Sample Mill LSMK (manufactured by AS ONE Corporation), subsequently 1.0 part of silica fine particles (H05TA, manufactured by Clariant Japan K.K.) having been subjected to hydrophobitization treatment with aminosilane and having a volume average primary particle size of 0.03 μm and 0.6 parts of conductive titania (EC300, manufactured by Titan Kogyo, Ltd.) were added thereto and the system was stirred for 1.5 minutes in total and mixed. After that, 2.0 parts of silica fine particles (H30TA, manufactured by Clariant Japan K.K.) having been subjected to hydrophobitization treatment with aminosilane and having a volume average primary particle size of 0.01 μm was added thereto and the system was stirred for 1.5 minutes in total and mixed. By sieving the mixture, toner D1-b for development was obtained.

Example 2-b

[Manufacture of Toner D2-b for Development]

Toner D2-b for development was obtained in the same manner as in Example 1-b except for changing the amount of silica fine particles (H05TA, manufactured by Clariant Japan K.K.) having been subjected to hydrophobitization treatment with aminosilane and having a volume average primary particle size of 0.03 μm and the amount of silica fine particles (H30TA, manufactured by Clariant Japan K.K.) having been subjected to hydrophobitization treatment with aminosilane and having a volume average primary particle size of 0.01 μm to 0.5 parts and 1.0 part, respectively.

Example 3-b

[Manufacture of Toner D3-b for Development]

Toner D3-b for development was obtained in the same manner as in Example 1-b except that 1.0 part of silica fine particles (H05TA, manufactured by Clariant Japan K.K.) having been subjected to hydrophobitization treatment with aminosilane and having a volume average primary particle size of 0.03 μm, 0.6 parts of conductive titania (EC300, manufactured by Titan Kogyo, Ltd.), and 2.0 parts of silica fine particles (H30TA, manufactured by Clariant Japan K.K.) having been subjected to hydrophobitization treatment with aminosilane and having a volume average primary particle size of 0.01 μm were added at the same time, and the system was stirred for 1.5 minutes and mixed.

Example 4-b

[Manufacture of Toner D4-b for Development]

Toner D4-b for development was obtained in the same manner as in Example 1-b except for changing the amount of silica fine particles (H05TA, manufactured by Clariant Japan K.K.) having been subjected to hydrophobitization treatment with aminosilane and having a volume average primary particle size of 0.03 μm and the amount of silica fine particles (H30TA, manufactured by Clariant Japan K.K.) having been subjected to hydrophobitization treatment with aminosilane and having a volume average primary particle size of 0.01 μm to 0.8 parts and 1.6 part, respectively.

Comparative Example 1-b

[Manufacture of Toner D5-b for Development]

Toner D5-b for development was obtained in the same manner as in Example 1-b except for changing the conductive titania (EC300, manufactured by Titan Kogyo, Ltd.) to 0.0 part (not added).

Comparative Example 2-b

[Manufacture of Toner D6-b for Development]

Toner D6-b for development was obtained in the same manner as in Example 1-b except for changing the amount of silica fine particles (H05TA, manufactured by Clariant Japan K.K.) having been subjected to hydrophobitization treatment with aminosilane and having a volume average primary particle size of 0.03 μm, the amount of conductive titania (EC300, manufactured by Titan Kogyo, Ltd.), and the amount of silica fine particles (H30TA, manufactured by Clariant Japan K.K.) having been subjected to hydrophobitization treatment with aminosilane and having a volume average primary particle size of 0.01 μm to 0.5 parts, 0.0 part (not added) and 1.0 part, respectively.

By using the toner mother particles or toner particles for development, evaluations were carried out as follows.

<Quantity of Charge (Measurement of Charge of Particles)>

As the carrier, F-150 (manufactured by Powder Tech Co., Ltd.) was used, and 10 g of a mixture of toner mother particles or toner particles for development and the carrier (weight ratio: 1/24) was put in a sample bottle made of glass having a capacity of 30 mL, and the sample was preserved for 12 hours or more under the conditions of 25° C. and a humidity of 50%. The sample was subjected to vibration for 1 minute with a mixer mill (manufactured by Mitamura Riken Kogyo Co., Ltd.) at vibration frequency of 600 rpm. By using 0.1 g of that sample, the quantity of charge was measured by means of a blow-off type charge quantity measuring device (manufactured by Toshiba Chemical Corp.) by the suction blow-off method.

Blow condition: 0.05 kgf×3 sec.

Pressure of suction: 350 to 400 mm $H_2O$

Screen: 400 mesh

<Blocking Resistance>

A toner for development (5 g) was put in a cylindrical container having an inner diameter of 3 cm and a height of 6 cm, a load of 40 g was applied thereto, and the toner was left to stand for 24 hours at a temperature of 50° C. and a humidity of 40%. After 24 hours, the toner was taken out of the container, and a load was applied to the toner to confirm the degree of aggregation.

◎ (Good): Collapsed by a load of less than 200 g

○ (Practicable): Collapsed by a load of less than 500 g x (Unusable): Aggregated and did not collapse when a load of 500 g or more is not applied <Measuring Method of Paper Fog (Evaluation of Printed Paper)>

By using an image forming apparatus under NN environment (25° C., 50% humidity), the color difference of the white background area of standard paper (OKI excellent white) between before and after printing was measured by X-Rite 938 (manufactured by X-Rite). Paper fog was judged by the size of ΔE according to the following criteria.

◎ (Good): $\Delta E<1.0$

○ (Slightly generated): $1.0\leq\Delta E<1.5$ x (Generated): $1.5\leq\Delta E$

In Examples 1b to 4b, paper fog under HH environment (35° C., 85% humidity) was further evaluated by the same measuring method and criteria of judgment. The criteria of judgment are the same as in NN environment.

<Coming Out of Image (Evaluation of Image Quality)>

The toners obtained in Examples 1-a to 7-a were used. Printing of an unfixed toner image of deposit of 300% (deposit: about 1.0 mg/cm$^2$) was performed at a printing rate of 21 ppm in a non-magnetic one-component system with a guaranteed number of copies of 12,000 (printing rate of 5%) on a recording paper (OKI excellent white) by means of a commercially available printer (HL 2140, manufactured by Brother Industries, Ltd.) equipped with a developing rubber roller, a metal blade, an organic photoreceptor charged by a charging roller (PCR) in which the fixing unit was detached. The following fixing test was performed by using the recording paper on which an unfixed toner image was printed.

<Fixing Test 1 (Belt Type)>

As the fixing device, a belt type fixing device capable of thermal fixation was used, and evaluated without coating silicone oil. A recording paper (OKI excellent white) having formed thereon an unfixed toner image of deposit of 300% (deposit: about 1.0 mg/cm$^2$) was prepared, and the surface temperature of the heating roller was changed from 100° C. to 195° C. with every 5° C. The recording paper was transported to a fixing nip part and discharged at a rate of 243 mm/sec. The fixing state at the time when the recording paper was discharged was observed.

A temperature region where the toner on the recording paper after fixing is sufficiently adhered to the recording paper without causing offset of the toner or winding of the paper on the heating roller during fixing is taken as the fixing temperature region.

The fixing temperature range in the fixing temperature region was taken as ΔT, and the fixing temperature range was judged according to the following criteria.

$\Delta T=T_{max}$ (the highest fixing temperature)$-T_{min}$ (the lowest fixing temperature)

◎: $\Delta T\geq 40°$ C.

○: $40°$ C.$\geq\Delta T\geq 30°$ C.

x: $\Delta T<30°$ C.

<Fixing Test 2 (Roll Type)>

The fixing device is a roll fixing type, and the release layer of the heating roll of the fixing device is made of PFA (tetrafluoroethylene-perfluoroalkyl vinyl ether copolymer). Evaluation was performed without silicone oil coating. Evaluation was performed without silicone oil coating. A recording paper (FC Dream, manufactured by Kishu Seishi Ltd.) having formed thereon an unfixed toner image of deposit of 300% (deposit: about 1.0 mg/cm$^2$) was prepared, and the surface temperature of the heating roller was changed from 100° C. to 210° C. with every 5° C. The recording paper was transported to a fixing nip part and discharged at a rate of 198 mm/sec. The fixing state at the time when the recording paper was discharged was observed.

A temperature region where the toner on the recording paper after fixing is sufficiently adhered to the recording paper without causing offset of the toner or winding of the paper on the heating roller during fixing is taken as the fixing temperature region.

The fixing temperature range in the fixing temperature region was taken as ΔT, and the fixing temperature range was judged according to the following criteria.

$\Delta T = T_{max}$ (the highest fixing temperature) $- T_{min}$ (the lowest fixing temperature)

◎: $\Delta T \geq 40°$ C.

○: 40° C. $\geq \Delta T \geq 30°$ C.

x: $\Delta T < 30°$ C.

<Gloss>

The gloss of the fixed image recorded on the recording paper in the fixing test was measured by Gloss Meter VG2000 (manufactured by NIPPON DENSHOKU INDUSTRIES CO., LTD.). The angle of measurement was set at 75°. The greater the number of the gloss, the higher is the gloss. In the fixing temperature region, the number showing the highest gloss is recorded as the highest gloss value.

◎ (High gloss): The highest gloss value is 40 or higher.

○: (Middle gloss): The highest gloss value is 25 to 40 or more.

x: (Low gloss): The highest gloss value is less than 25.

<Uniformity of Solid Image (Evaluation of Practical Printing)>

With respect to the solid images printed by using the toners obtained in Examples 1-b to 4-b and Comparative Examples 1-b and 2-b by means of a commercially available printer (HL 2140, manufactured by Brother Industries, Ltd.), the uniformity of solid images were visually observed.

◎ (Good): Density unevenness was not observed

○ (Slightly generated): Density unevenness was slightly observed x (Generated): Density unevenness was conspicuously observed The results of evaluations in Examples 1-a to 7-1 and Comparative Examples 1-a to 7-a, and the results of evaluations in Examples 1-b to 4-b and Comparative Examples 1-b and 2-b are respectively shown in the following tables.

TABLE 1

| | | Example | | | | | | |
|---|---|---|---|---|---|---|---|---|
| | | Example 1-a | Example 2-a | Example 3-a | Example 4-a | Example 5-a | Example 6-a | Example 7-a |
| Radical monomer | Number of n | 8.5 | 8.5 | 8.5 | 9.0 | 4.0 | 5.2 | 12.0 |
| | Content (width of toner) | 3.3 | 4.3 | 4.3 | 8.1 | 8.3 | 4.3 | 4.2 |
| Manufacturing property of particles | Polymerization process | ⊙ | ⊙ | ⊙ | ⊙ | ⊙ | ⊙ | ⊙ |
| | Polymer primary particles | B1-a | B2-a | B3-a | B4-a | B5-a | B6-a | B7-1 |
| | Aggregation process | ⊙ | ⊙ | ⊙ | ○ | ○ | ○ | ⊙ |
| | Toner mother particles | C1-a | C2-a | C3-a | C4-a | C5-a | C6-a | C7-a |
| | Toner particles for development | D1-a | D2-a | D3-a | D4-a | D5-a | D6-a | D7-a |
| Charging property of particles (μV/g) | Toner mother particles | 7.4 | 8.4 | 8.5 | 2.6 | 2.5 | 2.1 | 5.6 |
| | Toner particles for development | 17.8 | 13.9 | 17.0 | 7.2 | 7.9 | 12.5 | 17.5 |
| Blocking resistance | Toner particles for development | ⊙ | ○ | ○ | X | ○ | ⊙ | ○ |
| Evaluation of printed paper | Fogging | ○ | ⊙ | ○ | ⊙ | X | ⊙ | ○ |
| Evaluation of fixing (belt type) | Fixing temperature width | ⊙ | ⊙ | ⊙ | ⊙ | ⊙ | ⊙ | ⊙ |
| | Gloss | ⊙ | ⊙ | ○ | ⊙ | ⊙ | ⊙ | ⊙ |
| Evaluation of fixing (roll type) | Fixing temperature width | ⊙ | ○ | ⊙ | ⊙ | ○ | ○ | ○ |
| | Gloss | ○ | ○ | ○ | ⊙ | ⊙ | ⊙ | ⊙ |

| | | Example | | | | | | |
|---|---|---|---|---|---|---|---|---|
| | | Comparative Example 1-a | Comparative Example 2-a | Comparative Example 3-a | Comparative Example 4-a | Comparative Example 5-a | Comparative Example 6-a | Comparative Example 7-a |
| Radical monomer | Number of n | — | 1.0 | 2.0 | 23.0 | 90.0 | 2.0 | 8.5 |
| | Content (width of toner) | 0.0 | 23.5 | 1.5 | 9.5 | 4.3 | 12.5 | 12.5 |
| Manufacturing property of particles | Polymerization process | ⊙ | ⊙ | ⊙ | ⊙ | ⊙ | ⊙ | ⊙ |
| | Polymer primary particles | B8-a | B9-a | B10-a | B11-a | B12-a | B13-a | B14-a |
| | Aggregation process | ⊙ | X | X | X | X | X | X |
| | Toner mother particles | C8-a | C9-a | C10-a | C11-a | C12-a | C13-a | C14-a |
| | Toner particles for development | — | — | — | — | — | — | — |
| Charging property of particles (μV/g) | Toner mother particles | −24.9 | — | — | — | — | — | — |
| | Toner particles for development | — | — | — | — | — | — | — |
| Blocking resistance | Toner particles for development | — | — | — | — | — | — | — |
| Evaluation of printed paper | Fogging | — | — | — | — | — | — | — |
| Evaluation of fixing (belt type) | Fixing temperature width | — | — | — | — | — | — | — |
| | Gloss | — | — | — | — | — | — | — |
| Evaluation of fixing (roll type) | Fixing temperature width | — | — | — | — | — | — | — |
| | Gloss | — | — | — | — | — | — | — |

TABLE 2

| | | Example 1-b | Example 2-b | Example 3-b | Example 4-b | Comparative Example 1-b | Comparative Example 2-b |
|---|---|---|---|---|---|---|---|
| | Toner particles | D1-b | D2-b | D3-b | D4-b | D5-b | D6-b |
| Polymerizable monomer | Number of n | 8.5 | 8.5 | 8.5 | 8.5 | 8.5 | 8.5 |
| | Content (in toner mother particles) | 4.3 | 4.3 | 4.3 | 4.3 | 4.3 | 4.3 |

TABLE 2-continued

| | | Example 1-b | Example 2-b | Example 3-b | Example 4-b | Comparative Example 1-b | Comparative Example 2-b |
|---|---|---|---|---|---|---|---|
| External additives (parts by mass) | Silica A (small) | 2.0 | 1.0 | 2.0 | 1.6 | 2.0 | 1.0 |
| | Silica B (large) | 1.0 | 0.5 | 1.0 | 0.8 | 1.0 | 0.5 |
| | Conductive metal oxide | 0.6 | 0.6 | 0.6 | 0.6 | 0.0 | 0.0 |
| Measurement of particle charge (μV/g) | Toner particles for development | 21.1 | 14.5 | 19.4 | 18.1 | 21 | 16.3 |
| Blocking resistance | Toner particles for development | ⊙ | ○ | ⊙ | ⊙ | ⊙ | ○ |
| Paper fogging | NN condition | ⊙ | ⊙ | ⊙ | ⊙ | ⊙ | ⊙ |
| | HH condition | ⊙ | ⊙ | ⊙ | ⊙ | X | X |
| Evaluation of practical printing | Uniformity of solid image | ⊙ | ⊙ | ⊙ | ⊙ | ⊙ | ⊙ |

As is shown in the results of evaluations in Table 1, when a polymerizable monomer having an ether bond was contained as the constituting component of a binder resin, the toner mother particles showed a positively charging property. By externally treating these toner mother particles with an external additive containing positively charging inorganic particles having been subjected to hydrophobitizing treatment with an amino group-containing compound, a positively charging toner for development excellent in image quality and having high gloss could be obtained.

When the number of ether bonds in the repeating unit contained in a binder resin was out of the range of 4 or more and 20 or less, it was difficult to make toner particles by using such particles.

Further, as shown in the evaluation results in Table 2, by externally treating the toner mother particles showing a positive charging property with conductive fine particles, a positively charging toner for development excellent in environmental stability and especially not causing fogging in the use at high temperature and high humidity conditions. Further, by externally treating two kinds of silica having specific difference in the average particle size, a positively charging toner for development excellent in image quality could be obtained.

While the invention has been described in detail and with specific embodiment thereof, it will be apparent to one skilled in the art that various changes and modifications can be made without departing from the spirit and scope thereof.

The present application is related to Japanese patent application filed on Jul. 28, 2011 (Japanese Patent Application No. 2011-165935), and Sep. 7, 2011 (Japanese Patent Application No. 2011-194535), and the disclosures of which are incorporated herein by reference.

The invention claimed is:

1. A method comprising:

polymerizing one or more monomers which comprise a first monomer having 4 to 9 ether bonds and represented by Formula 1 by wet polymerization to obtain a binder resin; and adding a colorant to the binder resin to obtain a toner mother particle, wherein the binder resin comprises a repeating unit derived from the first monomer and has a weight average molecular weight of 42,000 to 2,000,000, the repeating unit accounting for 0.1 parts by mass to 10 parts by mass in 100 parts by mass of the toner mother particle:

Formula 1

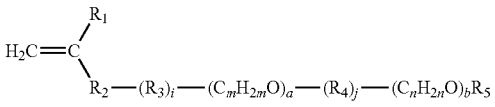

wherein $R_1$ represents a hydrogen atom or a methyl group; $R_2$ represents an ester group, an ether group, or a phenylene group; each of $R_3$ and $R_4$ represents a structure comprising a carbon atom, a hydrogen atom, and an oxygen atom; $R_5$ represents a structure comprising a carbon atom, a hydrogen atom, an oxygen atom, and, optionally, a chlorine atom; each of a and b independently represents an integer of 0 or more, and a sum of a and b is 2 or more; each of i and j independently represents 0 or 1; and each of m and n independently represents an integer of 1 or more.

2. The method as claimed in claim 1, wherein the toner mother particle is positively charged.

3. The method as claimed in claim 1, further comprising adding an external additive to the toner mother particle to obtain an electrostatic image developing toner.

4. The method as claimed in claim 3, wherein the external additive comprises an electrically conductive metal oxide.

5. The method as claimed in claim 4, wherein the external additive further comprises silica.

6. The method as claimed in claim 5, wherein the silica comprises silica A having a volume average primary particle size of 5 nm or more and 15 nm or less, and silica B having a volume average primary particle size greater than the volume average primary particle size of the silica A by 5 nm or more.

7. The method as claimed in claim 1, wherein the number of ether bonds in the first monomer is 6 or more.

8. The method as claimed in claim 1, wherein the repeating unit accounts for 8 parts by mass or less in 100 parts by mass of the toner mother particle.

9. The method as claimed in claim 1, wherein the one or more monomers further comprises a second monomer which has an acid group or a basic group.

10. The method as claimed in claim 1, wherein the colorant is added to the binder resin by aggregating a dispersion liquid which comprises primary particles of the binder resin and a dispersion liquid which comprises the colorant.

11. A method comprising:

polymerizing one or more monomers which comprise a first monomer having 4 to 9 ether bonds and represented by Formula 1 in a presence of a colorant by wet polymerization to obtain a toner mother particle which comprises a binder resin and the colorant, wherein the binder resin comprises a repeating unit derived from the first monomer and has a weight average molecular weight of 42,000 to 2,000,000, the repeating unit accounting for 0.1 parts by mass to 10 parts by mass in 100 parts by mass of the toner mother particle:

Formula 1

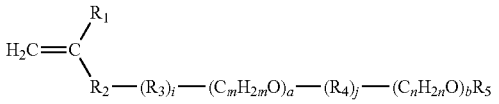

wherein $R_1$ represents a hydrogen atom or a methyl group; $R_2$ represents an ester group, an ether group, or a phenylene group; each of $R_3$ and $R_4$ represents a structure comprising a carbon atom, a hydrogen atom, and an oxygen atom; $R_5$ represents a structure comprising a carbon atom, a hydrogen atom, an oxygen atom, and, optionally, a chlorine atom; each of a and b independently represents an integer of 0 or more, and a sum of a and b is 2 or more; each of i and j independently represents 0 or 1; and each of m and n independently represents an integer of 1 or more.

12. The method as claimed in claim 11, wherein the toner mother particle is positively charged.

13. The method as claimed in claim 11, further comprising adding an external additive to the toner mother particle to obtain an electrostatic image developing toner.

14. The method as claimed in claim 13, wherein the external additive comprises an electrically conductive metal oxide.

15. The method as claimed in claim 14, wherein the external additive further comprises silica.

16. The method as claimed in claim 15, wherein the silica comprises silica A having a volume average primary particle size of 5 nm or more and 15 nm or less, and silica B having a volume average primary particle size greater than the volume average primary particle size of the silica A by 5 nm or more.

17. The method as claimed in claim 11, wherein the number of ether bonds in the first monomer is 6 or more.

18. The method as claimed in claim 11, wherein the repeating unit accounts for 8 parts by mass or less in 100 parts by mass of the toner mother particle.

19. The method as claimed in claim 11, wherein the one or more monomers further comprises a second monomer which has an acid group or a basic group.

20. The method as claimed in claim 1, wherein the binder resin is obtained by emulsification polymerization, and a volume average particle size of the primary particles of the binder resin is 0.1 μm or more and 1 μm or less.

* * * * *